US009683403B2

(12) United States Patent
Wang

(10) Patent No.: US 9,683,403 B2
(45) Date of Patent: Jun. 20, 2017

(54) CLOSURE ASSEMBLY WITH A WINDOW AND A METHOD OF MAKING THE SAME

(71) Applicant: Nan Ya Plastics Corporation, Taipei (TW)

(72) Inventor: Kuei-Yung Wang, Taipei (TW)

(73) Assignee: NAN YA PLASTICS CORPORATION (TW)

( * ) Notice: Subject to any disclaimer, the term of this patent is extended or adjusted under 35 U.S.C. 154(b) by 0 days.

(21) Appl. No.: 14/825,390

(22) Filed: Aug. 13, 2015

(65) Prior Publication Data

US 2016/0060947 A1 Mar. 3, 2016

(30) Foreign Application Priority Data

Jun. 5, 2015 (TW) ..... 104208978 U
Jun. 5, 2015 (TW) ..... 104208979 U
Aug. 4, 2015 (GB) ..... 1513798.7

(51) Int. Cl.
*E06B 3/58* (2006.01)
*E06B 3/82* (2006.01)
*E06B 3/70* (2006.01)

(52) U.S. Cl.
CPC ..... *E06B 3/5892* (2013.01); *E06B 3/822* (2013.01); *E06B 3/7001* (2013.01); *E06B 2003/7023* (2013.01)

(58) Field of Classification Search
CPC ..... E06B 3/5892; E06B 3/822; E06B 2003/7023; E06B 3/7001
See application file for complete search history.

(56) References Cited

U.S. PATENT DOCUMENTS 4,327,535 A 5/1982 Governale ..... 52/309.11
4,965,030 A * 10/1990 Thorn ..... E06B 3/22 264/328.12
6,151,849 A 11/2000 Twigg et al.
(Continued)

FOREIGN PATENT DOCUMENTS

EP 0907000 A1 4/1999
EP 0974726 A2 1/2000
(Continued)

OTHER PUBLICATIONS

Supplementary European Search Report dated Nov. 28, 2016 in corresponding European Patent Application No. 15 19 5905 (total 4 pages).

(Continued)

*Primary Examiner* — Rodney Mintz
(74) *Attorney, Agent, or Firm* — Ostrolenk Faber LLP

(57) ABSTRACT

A closure assembly and a method of making the closure assembly with a window. The closure assembly includes front and rear panels defining a space between them; an aperture in each of the front and rear panels, the apertures being aligned to form an aperture in the closure assembly for the window; a frame at least partly positioned between the front and rear panels and extending along the aperture of the closure assembly, delineating a portion of the space and defining a cavity between the front and rear panels; and filling material located in the cavity and bonding the front and rear panels together in a one-piece structure.

25 Claims, 25 Drawing Sheets

(56) References Cited

U.S. PATENT DOCUMENTS 6,161,363 A * 12/2000 Herbst ..... E06B 3/7001 160/371
6,553,735 B1 * 4/2003 Wang Chen ..... E06B 3/5892 52/204.6
6,574,935 B2 * 6/2003 Wang Chen ..... E06B 3/5892 52/204.62
6,619,005 B1 * 9/2003 Chen ..... E06B 3/5892 49/502
7,448,174 B2 * 11/2008 Krochmal ..... E06B 3/5878 52/127.8
7,506,484 B2 * 3/2009 Geller ..... A47B 88/0044 220/315
2002/0092254 A1 * 7/2002 Wang Chen ..... E06B 3/5892 52/455
2004/0144046 A1 * 7/2004 Wang ..... E06B 3/5892 52/204.1
2005/0016091 A1 * 1/2005 Chen ..... E06B 3/5892 52/204.1
2007/0204546 A1 * 9/2007 Lynch ..... E06B 3/5892 52/456
2008/0209826 A1 * 9/2008 Hodges ..... E06B 3/5892 52/204.7
2008/0251183 A1 * 10/2008 Turner ..... B29C 44/1233 156/79
2008/0254243 A1 10/2008 Turner ..... 428/34.1
2010/0064625 A1 * 3/2010 Charlton ..... E06B 3/5892 52/656.4
2010/0229500 A1 * 9/2010 Lynch ..... E06B 3/5892 52/784.13
2013/0139467 A1 * 6/2013 Thompson ..... E06B 1/36 52/656.5
2015/0247355 A1 * 9/2015 Badger ..... E06B 3/5892 52/208
2015/0252612 A1 * 9/2015 Charlton ..... E06B 3/5892 52/656.5
2016/0032640 A1 * 2/2016 Wang Chen ..... E06B 3/72 49/502

FOREIGN PATENT DOCUMENTS

GB 2289708 A 11/1995
GB 2352468 A 1/2001
TW EP 2204526 A1 * 7/2010 ..... E06B 3/5481
TW M488541 U 10/2014

OTHER PUBLICATIONS

United Kingdom Search Report, dated Feb. 8, 2016, issued in corresponding United Kingdom Patent Application No. GB1514422.3. Total 6 pages.
United Kingdom Search Report, dated Feb. 9, 2016, issued in corresponding United Kingdom Patent Application No. GB1513798.7. Total 3 pages.

* cited by examiner

CLOSURE ASSEMBLY WITH A WINDOW AND A METHOD OF MAKING THE SAME

The present invention relates to a closure assembly with a window, for example particularly, but not exclusively, a composite door with a window.

BACKGROUND OF THE INVENTION

The assembling of a conventional door with a window is a complicated and/or wasteful process.

It is common for conventional composite doors to include one or more glazing apertures in which a glass panel is disposed, thereby forming a window or the like to permit penetration of light. The door has a core sandwiched between two skins. The core is usually filled with foam material. Drilling or milling through the skins and the core using the CNC system is required to create a glazing aperture in the door for assembling a glass panel by using front and rear cassette members which interlock to hold the glass panel in the glazing aperture.

The drilling or milling through a readymade door blank results in huge wastage of material attributable to the overall costs in the manufacture and fabrication of the composite door. The wastage increases with the number of glazing apertures.

The invention seeks to eliminate or at least to mitigate such shortcomings by providing a new or otherwise improved closure assembly with window and a new or otherwise improved method of making the same.

Traditional cassette stands proud of the surface of the door when fitted. Further still, it may be difficult to disassemble for replacement of the glass panel in the glazing aperture.

One of the embodiments of the invention seeks to mitigate this problem.

SUMMARY OF THE INVENTION

According to a first aspect of the invention, there is provided A closure assembly with a window comprising front and rear panels defining a space there between; an aperture in each of the front and rear panels, the aperture being aligned to form an aperture for the window; a frame at least partly positioned between the front and rear panels and extending along the aperture to delineate the space and define a cavity between the front and rear panels; and filling material placed in the cavity and bonding the front and rear panels together thereby forming a one-piece structure.

Preferably, the frame is fixed in position between the front and rear panels by engagement means.

More preferably, the engagement means includes: a first engaging member extending into the space between the front and the rear panels; and a second engaging member configured to receive the first engaging member.

Yet more preferably, the first engaging member comprises a receiving zone delimited by a pair of positioners which extend substantially traverse to the front and rear panels into the space there between, and wherein the second engaging member comprises a projection dimensioned to be received in the receiving zone such that when the first and second engaging member engages, relative planar movement between the panel and the frame in a first direction is confined.

Advantageously, the front and rear panels each being provided with a first engaging member and the frame has two second engaging members for engaging with respective first engaging member.

More advantageously, the pair of positioners includes a first rib extending around the aperture and a second rib extending substantially parallel to and spaced from the first rib to define the receiving zone.

Yet more advantageously, the second rib comprises a plurality of discontinuous rib sections.

Preferably, the frame includes an inner frame sandwiched between the front and rear panels and a holder extending into the aperture and running substantially parallel to the panels for holding a piece of glass for the window.

More preferably, the holder includes a first holding member integrally formed with the inner frame and extends therefrom into the aperture, and a second holding member co-operable with the first holding member for holding the piece of glass for the window.

Yet more preferably, the second holding member is retained on the frame by a retainer for fixing relative position between the first and second holding members.

Advantageously, the retainer comprises a releasable retainer such that the second holding member is releasably retained on the frame.

More advantageously, the retainer includes first and second retaining members that interlock to fix the relative position between the first and second holding members.

Yet more advantageously, the first retaining member is provided on the frame for snap fastening with the second retaining member which is provided on the second holding member, such that the piece of glass for the window is secured to the aperture by a one step process of placing the second holding member in position.

Preferably, the retaining members are releasably coupled.

Preferably, wherein the front and rear panels constitute front and rear outer surfaces of the closure assembly, the first and second holding members, when assembled, are embedded in the space between the front and rear skins and in the apertures without protruding beyond the outer surfaces.

More preferably, the inner frame and the holder are separate parts.

Yet more preferably, the holder includes first and second holding members which grip onto the respective front and rear panel and cooperate with one another to hold the piece of glass for the window.

Advantageously, the first and second holding members are provided with a locking means that interlocks to fix relative position between the first and second holding members.

More advantageously, the first and second holding members form continuous loops around the aperture and on the respective front and rear panels when assembled.

Preferably, the first and second holding members are identical in construction.

More preferably, the holder comprises conventional glazing cassette.

Advantageously, the front and rear panels each include at least two apertures separated by a divider.

More advantageously, the divider is removable to form an enlarged aperture integrating the two apertures.

Preferably, the frame is fixed in position between the front and rear panels by a first engaging member that extends into the space between the front and the rear panels; and a second engaging member configured to receive the first engaging member, wherein the first engaging member comprises a first rib which extends substantially around the aperture and delineates the divider such that when the divider is removed, the enlarged aperture is surrounded by the first rib.

More preferably, a panel is formed on the first skin with a first rib surrounding periphery of the panel and a second rib surrounding the first rib and being radially displaced therefrom.

Yet more preferably, the second rib comprises a plurality of discontinuous rib sections.

It is preferable that, the panels and the respective apertures are formed by compression molding.

Advantageously, the panels and the respective apertures are formed by stamping or punching.

In a second aspect of the invention there is provided a method of making a closure assembly comprising the steps of:

a) providing front and rear panels with apertures formed thereon;

b) positioning the front and rear panels to define a space there between; the aperture on the panels are aligned to form an aperture for the window; and c) positioning a frame between the front and rear panels and extending along the aperture to delineate the space and define a cavity between the front and rear panels; and d) placing a filling material in the cavity and bonding the front and rear panels together thereby forming a one-piece structure.

Preferably, the frame includes an inner frame sandwiched between the front and rear panels and a holder extending into the aperture and running substantially parallel to the panels for holding a piece of glass for the window, wherein the holder includes a first holding member integrally formed with the inner frame and extends therefrom into the aperture, and a second holding member co-operable with the first holding member for holding the piece of glass for the window.

More preferably, the second holding member is retained on the frame by a retainer for fixing relative position between the first and second holding members.

Yet more preferably, the retainer comprises a releasable retainer such that the second holding member is releasably retained on the frame.

Advantageously, the step c) involves placing the piece of glass on the first holding member, and snap fitting the second holding member to the frame for coupling the retainers to thereby sandwich the piece of glass between the first and second holding members.

More advantageously, the frame includes an inner frame sandwiched between the front and rear panels and a holder extending into the aperture and running substantially parallel to the panels for holding a piece of glass for the window, wherein the inner frame and the holder are separate parts.

Preferably, the holder comprises a conventional glazing cassette.

More preferably, the front and rear panels each includes a paneling and the method further includes the step of removing the paneling from the front and rear panels to form corresponding apertures thereon after step a).

It is preferable that the method further comprising a step of forming front and rear panels by way of compression molding, molding compound, stamping and/or punching.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
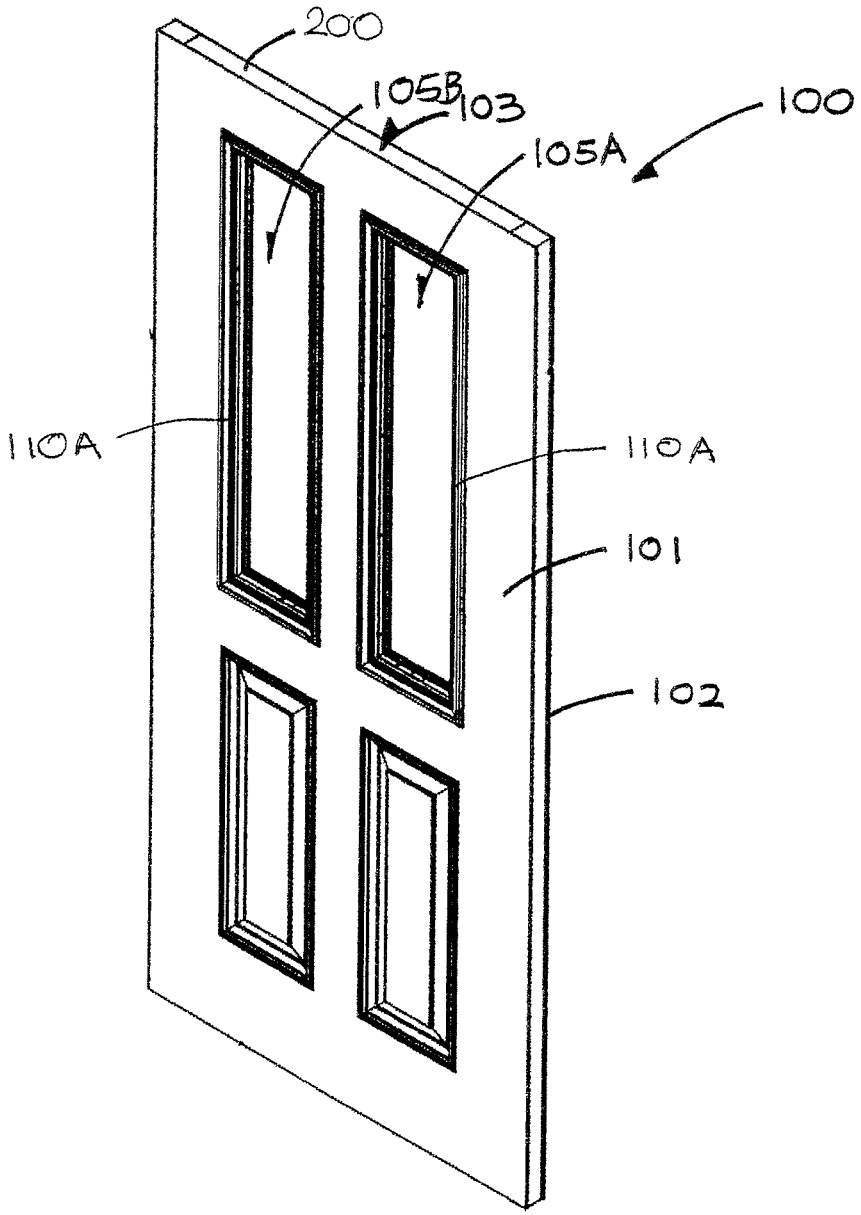
FIG. 1 is a perspective view of a closure assembly of a first embodiment in accordance with the invention.

Referring to FIGS. 1 to 12 of the drawings, there is shown a first embodiment of a closure assembly in accordance with the invention. The closure assembly is preferably in the form of a composite door blank 100 with a front panel 101 and a rear panel 102 sandwiching a core 103. The front and rear panels 101 and 102 are relatively thin and may be better described as front and rear skins 101 and 102 defining a space therebetween. The core 103 includes a filling material injected between the skins 101 and 102. The filling material may be but not limited to polyurethane foam, phenolic foam or Styrofoam (i.e. closed-cell extruded polystyrene foam) to provide rigidity to the door blank 100. The skins 101 and 102 may be made of, for example, fiberglass, PVC, fiber reinforcement plastic, steel, high-density fiberboard or medium-density fiberboard.

Figure 27:
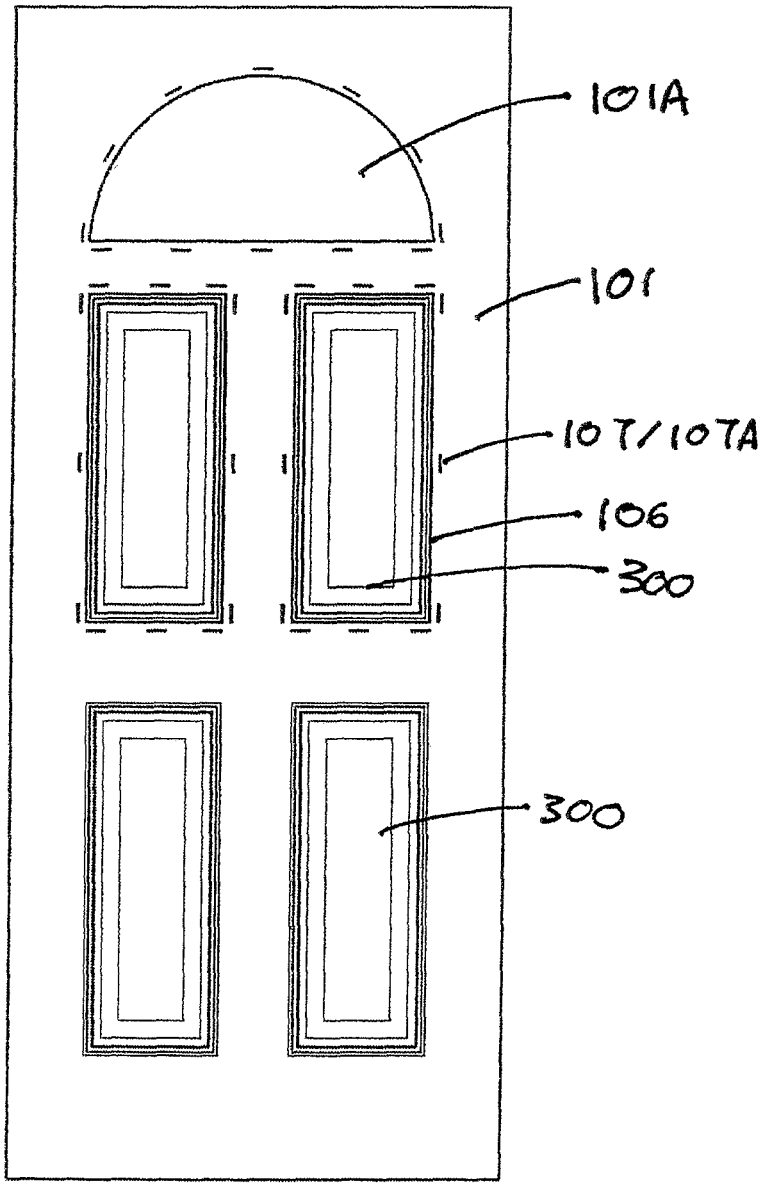
FIG. 27 is a front view of a forth embodiment of a front skin in the closure assembly in any of FIGS. 1 to 24 with a hemispherical aperture.

The door blank 100 has one or more windows with respective glazing panels 104. The number of windows on a door blank 100 may be varied according to the customer's needs. Each window includes a glazing aperture 105A/105B with a glazing panel 104 mounted therein. The glazing panel 104 is preferably of the double-glazing type, i.e. consisting of two panes of glass panels. The window can be of any sizes and shapes (for example, oval, circular and hemispherical as shown in FIG. 27).

The front and rear skins 101 and 102 and apertures 101A/101B or 102A/102B are formed by compression molding or molding compound. Alternatively, they are stamped out of a larger sheet of material. During the stamping process, apertures 101A/101B or 102A/102B are punched in the related skin 101 or 102. In other words, the skin 101 or 102 with the apertures 101A/101B or 102A/102B is produced in a single step.

A first embodiment of the door 100 is shown in FIGS. 1 to 13.

In summary, the front and rear skins 101 and 102 define a space therebetween. The apertures 101A, 101B, 102A and 102B in the skins 101 and 102 are aligned to form glazing aperture 105A and 105B. The frame, which includes the inner frame 109 and the holding members 110, is partly positioned between the skins 101 and 102 and extends along the glazing aperture 105A and 105B to delineate the space and define the cavity between the skins 101 and 102. The filling material is placed in the cavity to form the core 103 and bonds the skins 101 and 102 together forming a one-piece structure.

The front and rear skins 101 and 102 are of the same construction. Taking the front skin 101 as an example and referring to FIGS. 3 to 5, around each of the glazing apertures 101 A and 101 B there is provided a first engaging member that includes a positioner. The positioner has a first rib 106 which is preferably in the form of a complete loop extending substantially around the apertures 101A and 101B; and a second rib 107 that extends substantially parallel to the first rib 106. In the preferred embodiment, the second rib 107 is made up of a plurality of discrete rib sections 107A. The first and second ribs 106 and 107 are displaced radially to define a receiving zone 108 for receiving and hence positioning a second engaging member provided on a frame for each glazing aperture 101A/101B.

In the preferred embodiment, the aforesaid frame includes an inner frame 109 and a holder 110. The inner frame 109 is preferably a rectangular frame with a front flange/projection 109A and a rear flange/projection 109B, each constituting the second engaging member to be fitted into or dimensioned to be received by the receiving zone 108. Between the flanges 109A and 109B there is a continuous loop of web 109C extending across and perpendicular to the flanges 109A and 109B. Extending transversely to the web 109C are numerous cross ribs 109D for enhancing the rigidity of the overall inner frame 109. In this embodiment, the inner frame 109 is of a rectangular shape. As an alternative, the inner frame can be of any other shapes matching the shape of the aperture 101A/101B.

Figure 6:
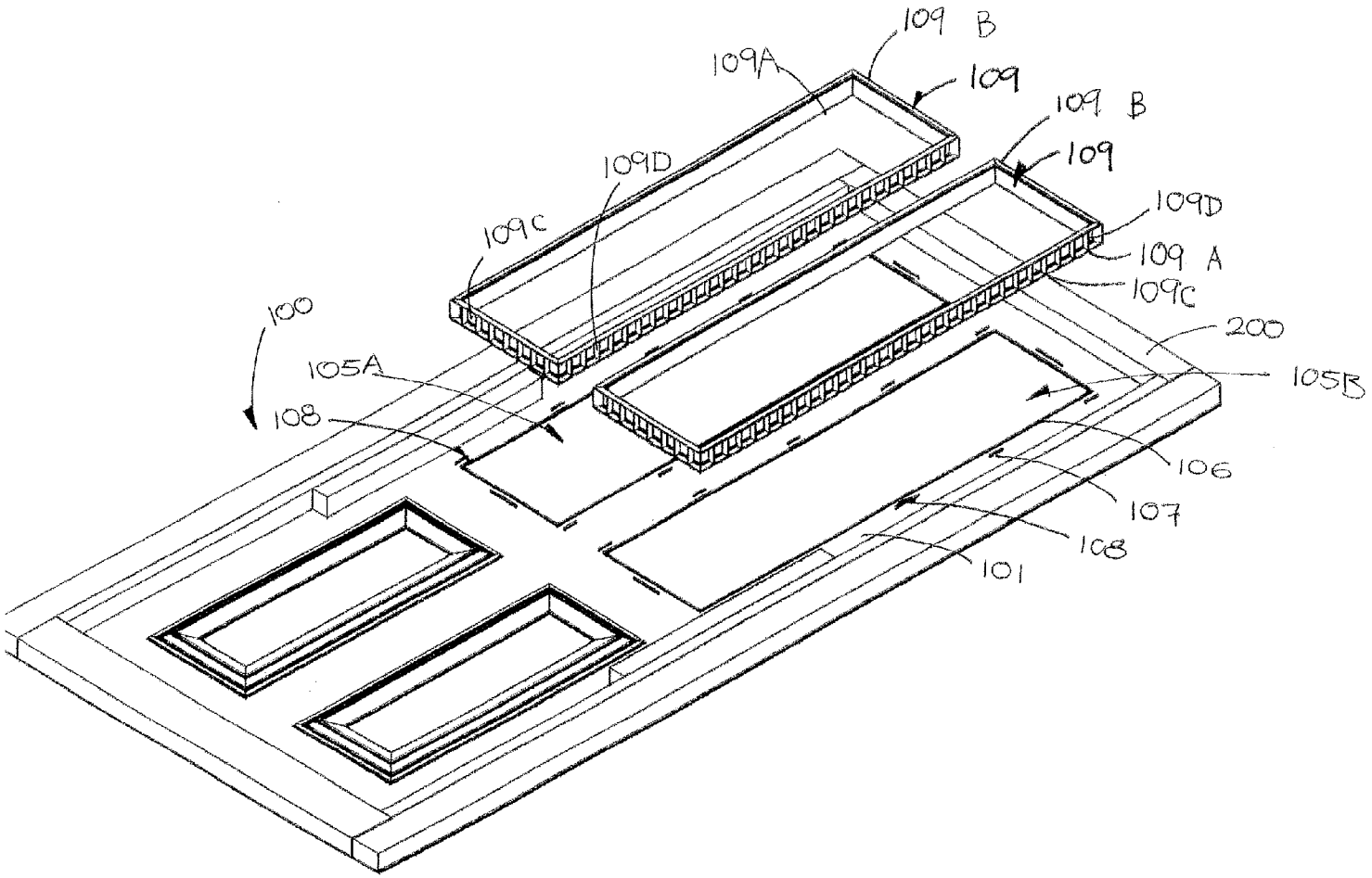
FIG. 6 is a perspective view of the front skin in FIG. 5 with the inner frame to be assembled to apertures thereon
Figure 7:
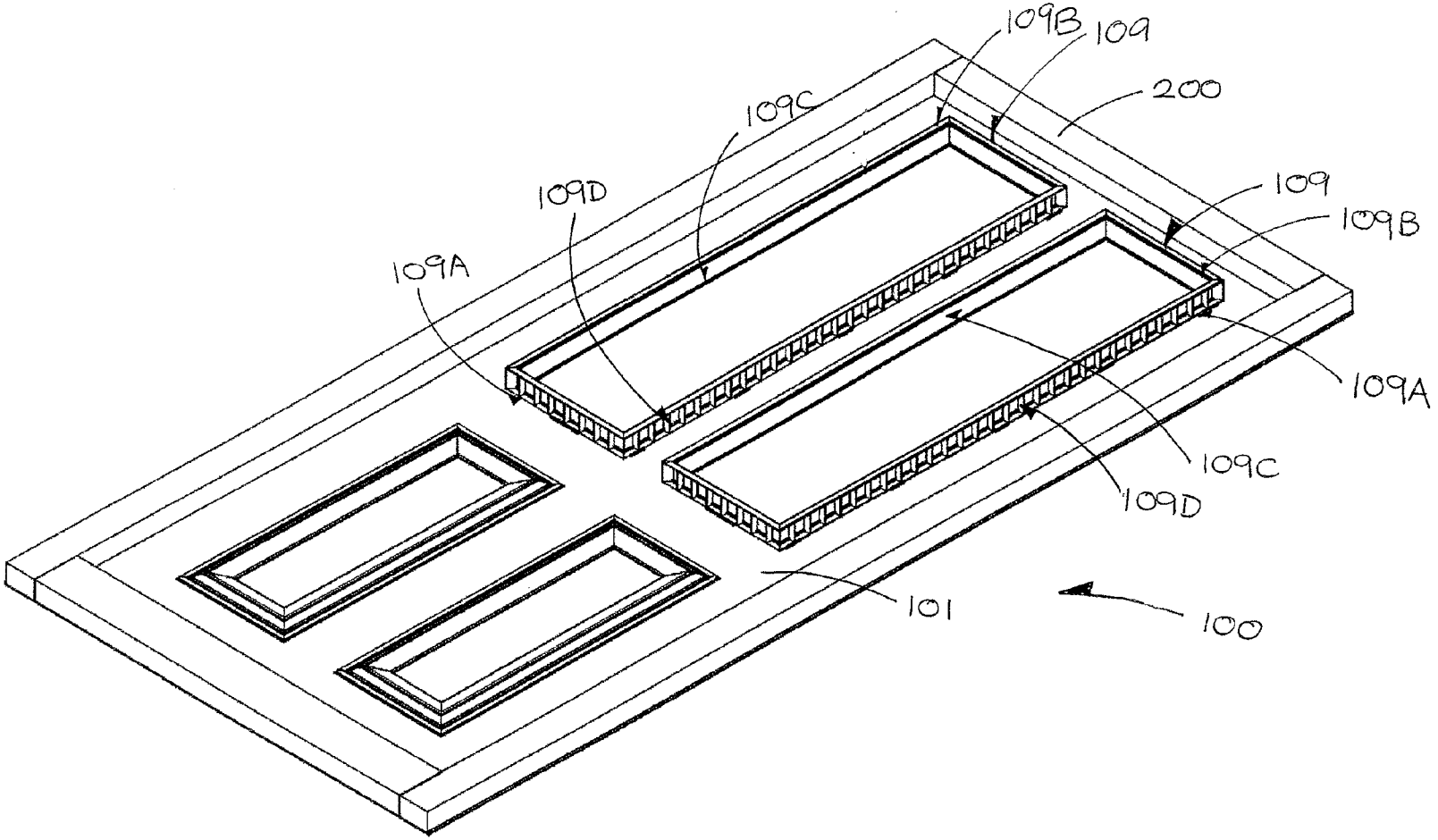
FIG. 7 is a perspective views of the front skin in FIG. 6 with the inner frame assembled thereto.

As shown in FIGS. 6 and 7, the front skin 101 is laid flat and a reinforcement frame 200 is placed on an inner side of the front panel 101 and along its outer perimeter. The reinforcement frame 200 may be made of PVC, wood or any other suitable material available in the field. Lock blocks 201 are placed adjacent the reinforcement frame 200 widening it at the desired position to form foundations for installation of a door lock on either side of the door blank 100. The inner frame 109 is placed on the front skin 101 with its front flange 109A inserted into the receiving zone 108 defined by the first and second ribs 106 and 107. The ribs 106 and 107 prevent the relative planar movement of the frames 109 relative to the inner side of the front skin 101.

Figure 8:
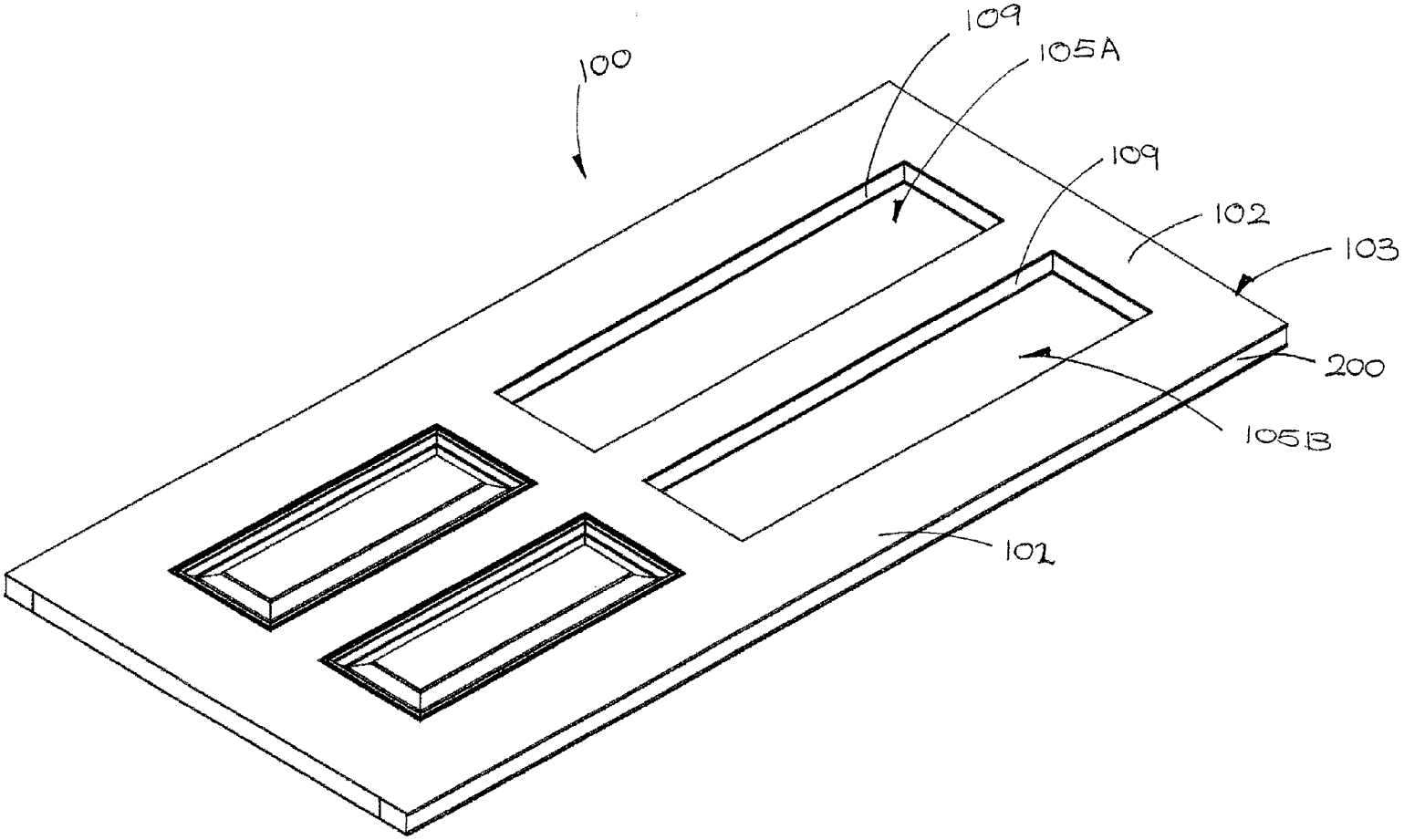
FIG. 8 is a perspective view of the closure assembly in FIG. 7 with a rear skin installed.

Referring to FIG. 8, the rear skin 102 is placed on the reinforcement frame 200 sandwiching the inner frame 109. Adhesive may be used to bond the skins 101 and 102 to at least the reinforcement frame 200. As mentioned, the rear skin 102 is of a very similar if not the same construction as the front skin 101. There are first and second ribs 106 and 107 around the apertures 102A and 102B defining the receiving zone 108 for receiving the rear flange 109B of the inner frame 109. The ribs 106 and 107 restrict the relative movement of the rear skin 102 and the frame 109.

Once the inner frame 109 is in place, sandwiched between the front and rear skins 101 and 102, the web 109C of the inner frame 109, the front and rear skins 101 and 102, the reinforcement frame 200 as well as the lock blocks 201 together define a cavity surrounded by these components. The front and rear skins 101 and 102 are mechanically pressed in opposite directions against the inner frame 109, the reinforcement frame 200 as well as the lock blocks 201 while the filling material is introduced, preferably by injection into the cavity to form the core 103. The filling material bonds the skins 101 and 102 and the inner frame 109 as well as the reinforcement frame 200 together, thereby forming a one-piece structure.

When filling material is inserted into the cavity, it fills the gaps between the cross ribs 109D. As the filling material hardens, the inner frame 109 is attached securely to the skins 101 and 102. The ribs 109D are features useful in enhancing the attachment of the inner frame 109 to the panels 101 and 102 by increasing the surface area on which the filling material adheres. They also function as mechanical reinforcement of the inner frame 109.

The inner frame 109 and the apertures 101A, 101B, 102A and 102B of the front and rear skins 101 and 102 define the glazing aperture 105A/105B. A key function of the inner frame 109 is to prevent the filling material from entering the space within and between the apertures 101A, 101B, 102A and 102B and to provide rigidity to the glazing aperture 105A/105B.

Figure 10:
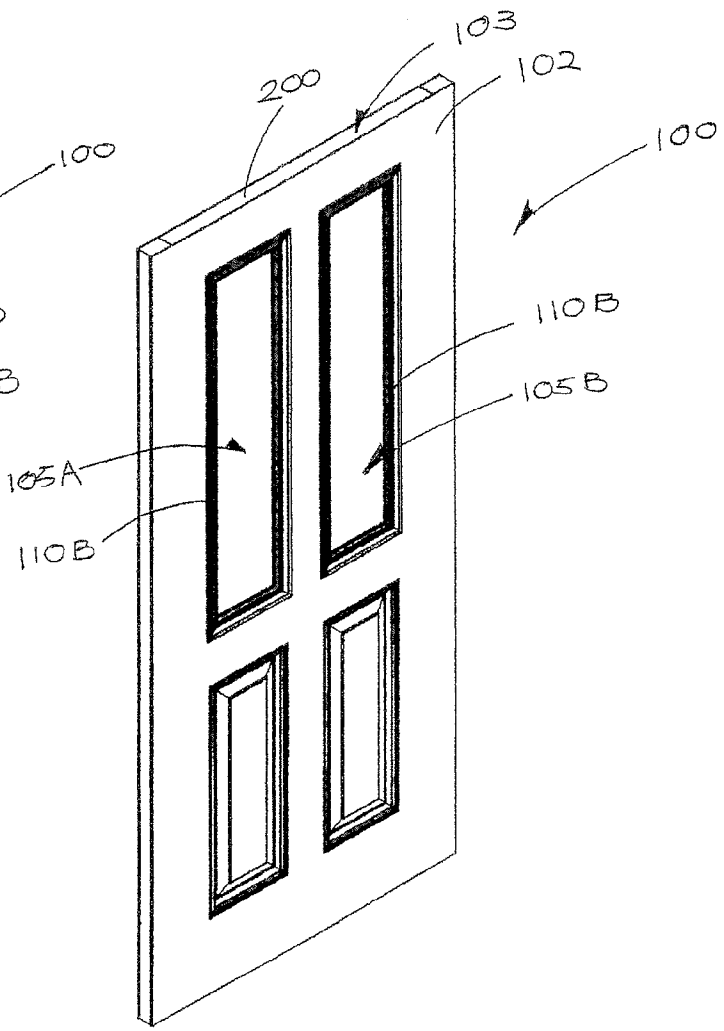
FIG. 10 is a perspective view of the closure assembly in FIG. 9 with the first holding member to the apertures.
Figure 9:
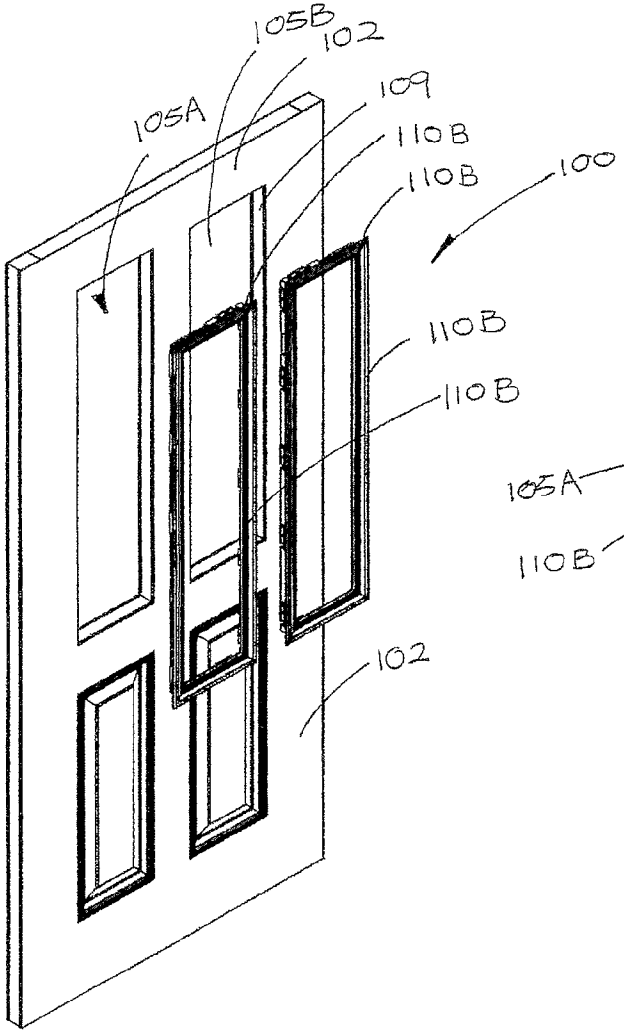
FIG. 9 is a perspective view of the closure assembly in FIG. 8 with a first holding member of a holder to be assembled to the apertures thereon.
Figure 12:
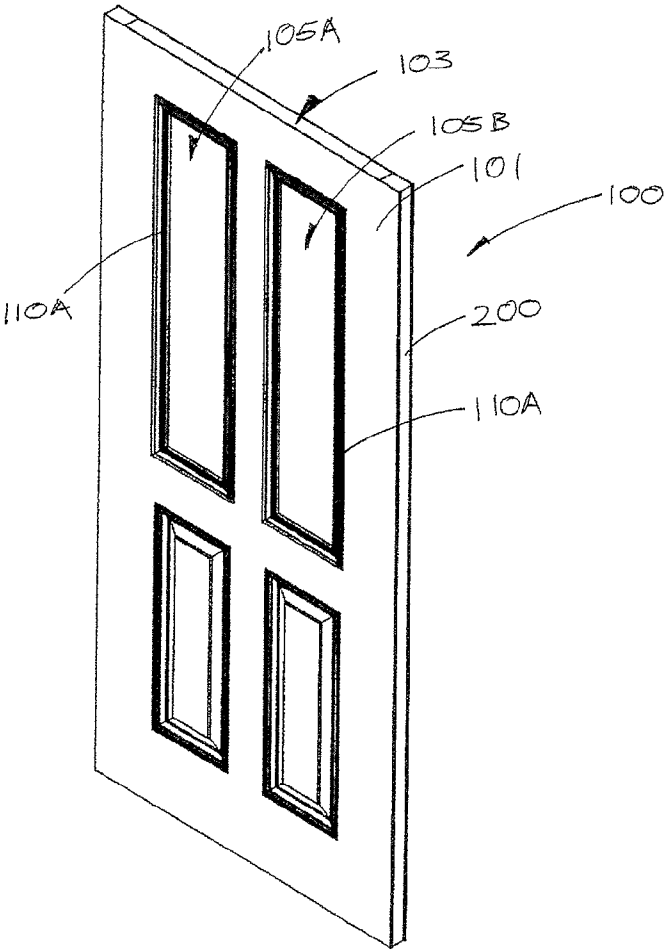
FIG. 12 is a perspective views of the closure assembly in FIG. 11 with the second holding member assembled to the apertures.
Figure 11:
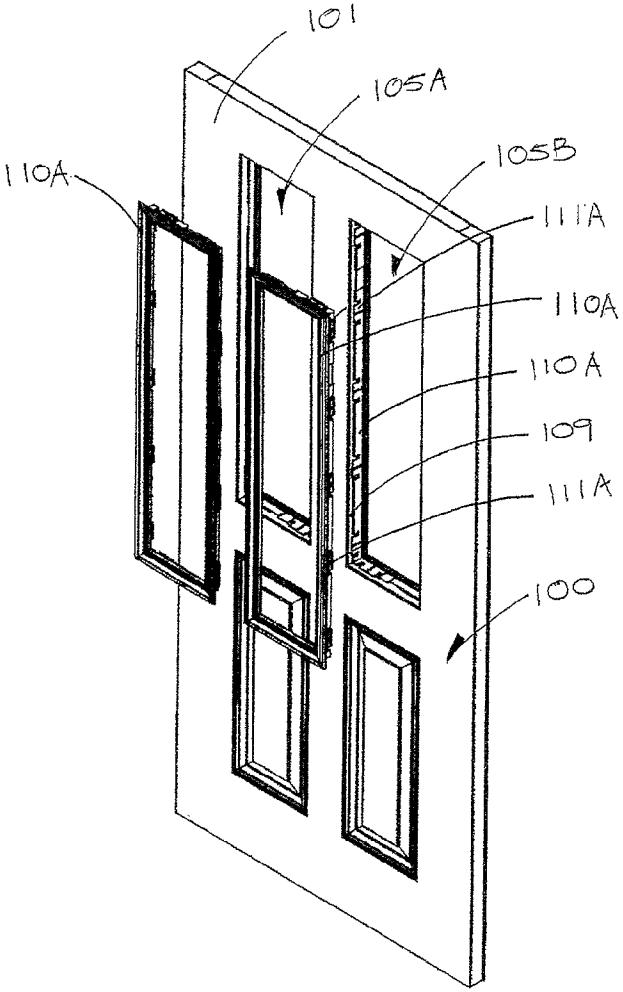
FIG. 11 is a perspective view of the closure assembly in FIG. 10 with a second holding member of a holder to be assembled to the apertures thereon.
Figure 13B:
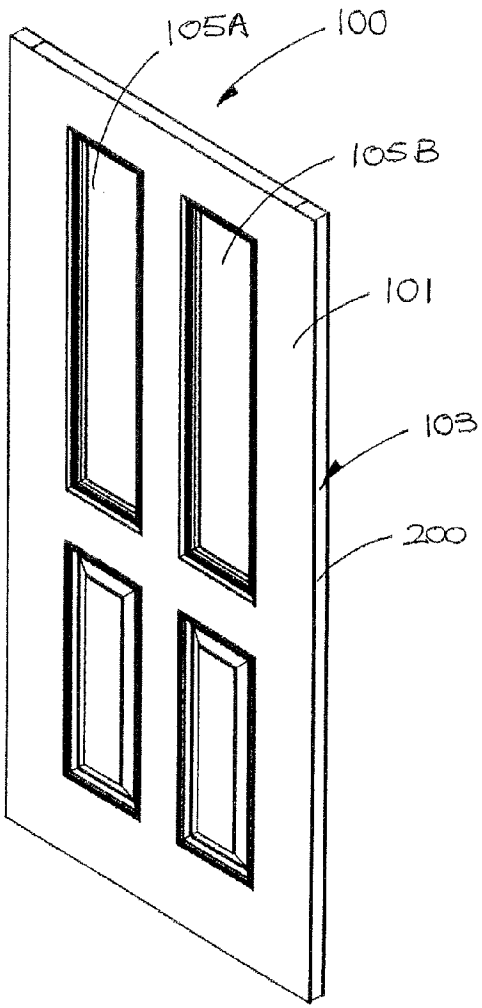
FIGS. 13A and 13B are perspective views of a second embodiment of the closure member in accordance with the invention.
Figure 13A:
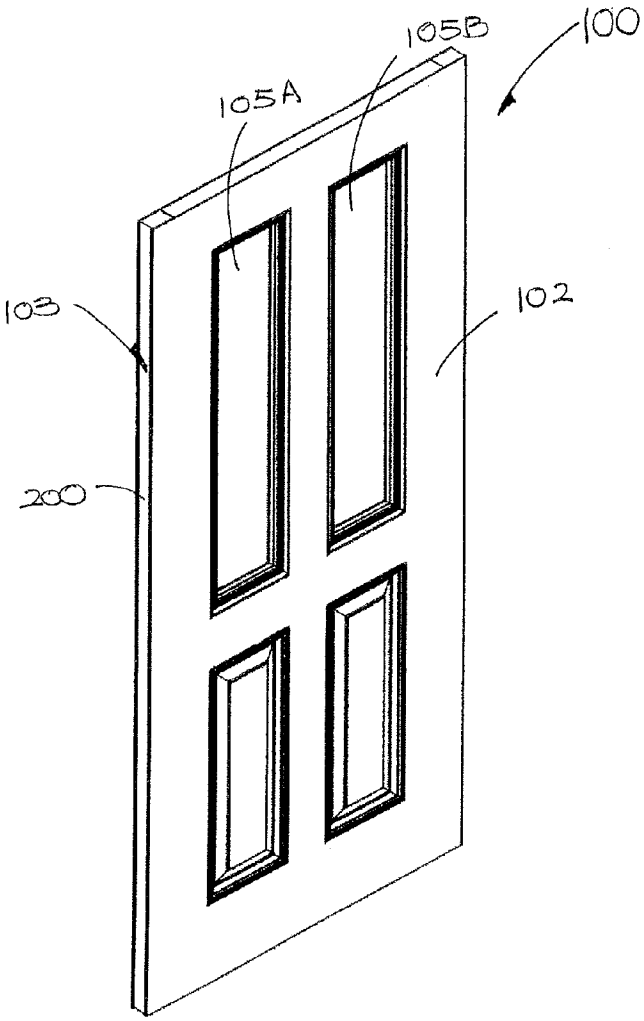

Referring to FIGS. 9 to 11, a holder 110 enters the glazing aperture 105A/105B and runs substantially parallel to the skins 101 and 102 for holding the glazing panel 104 in the glazing aperture 105A/105B. The holder 110 is a two-part structure with a first holding member 110A and a second holding member 110B. In this embodiment, the first and second holding members 110A and 110B are parts separate or distinct from the inner frame 109 and are preferably in the form of a conventional cassette. In a second embodiment of the invention as shown in FIGS. 13 to 24, one of the first and second holding members 110A and 110B is integrally formed with the front flange 109A of the inner frame 109.

Going back to the first embodiment of the invention, as mentioned, the holder 110 is preferably a conventional glazing cassette. The first and second holding members 110A and 110B are identical in construction, and are complementary when one is flipped for inter-engagement. Retainers, preferably in the form of hooks and/or latches, are provided to lock the two holding members 110A and 110B together with the glazing panel 104 sandwiched therebetween.

Figures 2A, 2B, 2C:
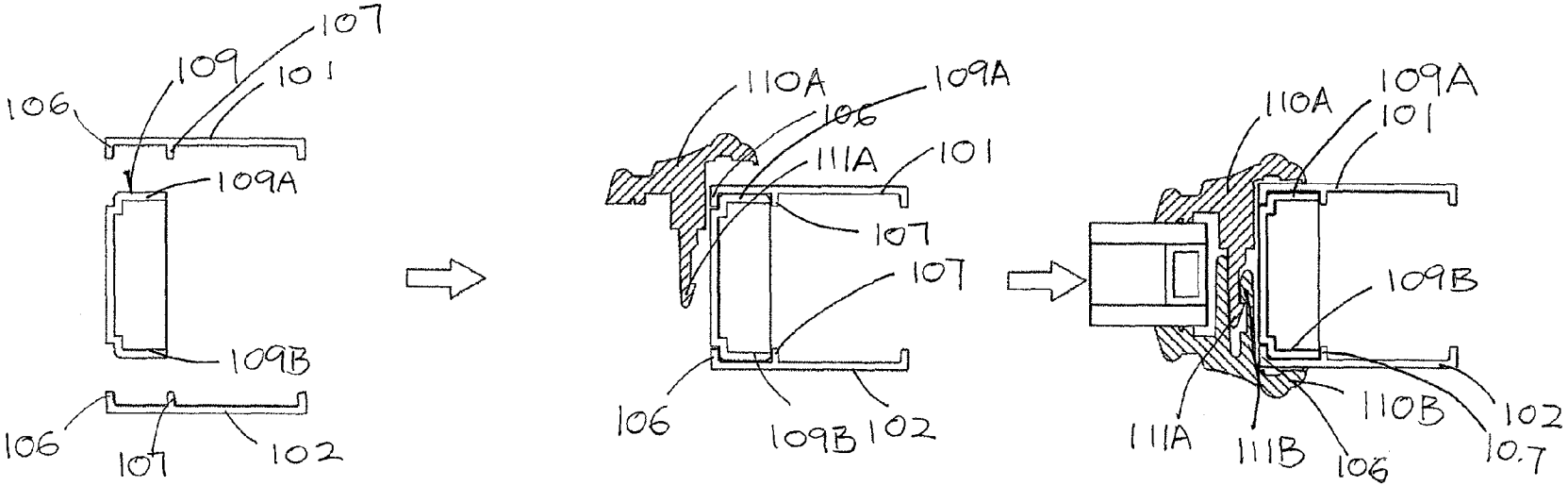
FIGS. 2A to 2C are schematic diagrams showing how a glazing panel for a window in the closure assembly in FIG. 1 is assembled.
Figure 3:
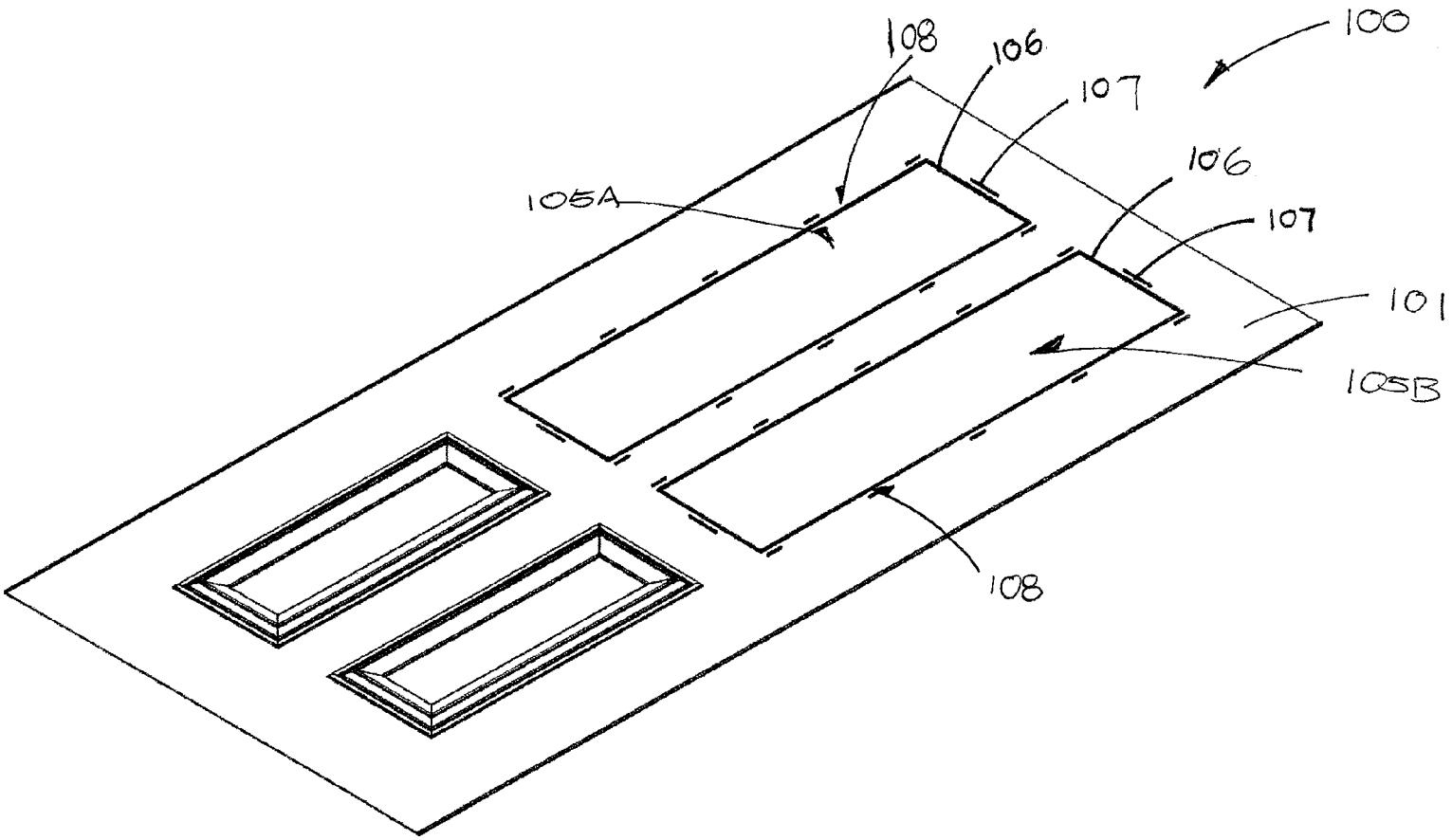
FIG. 3 is a perspective view of a first embodiment of a front skin of the closure assembly in FIG. 1.
Figure 4:
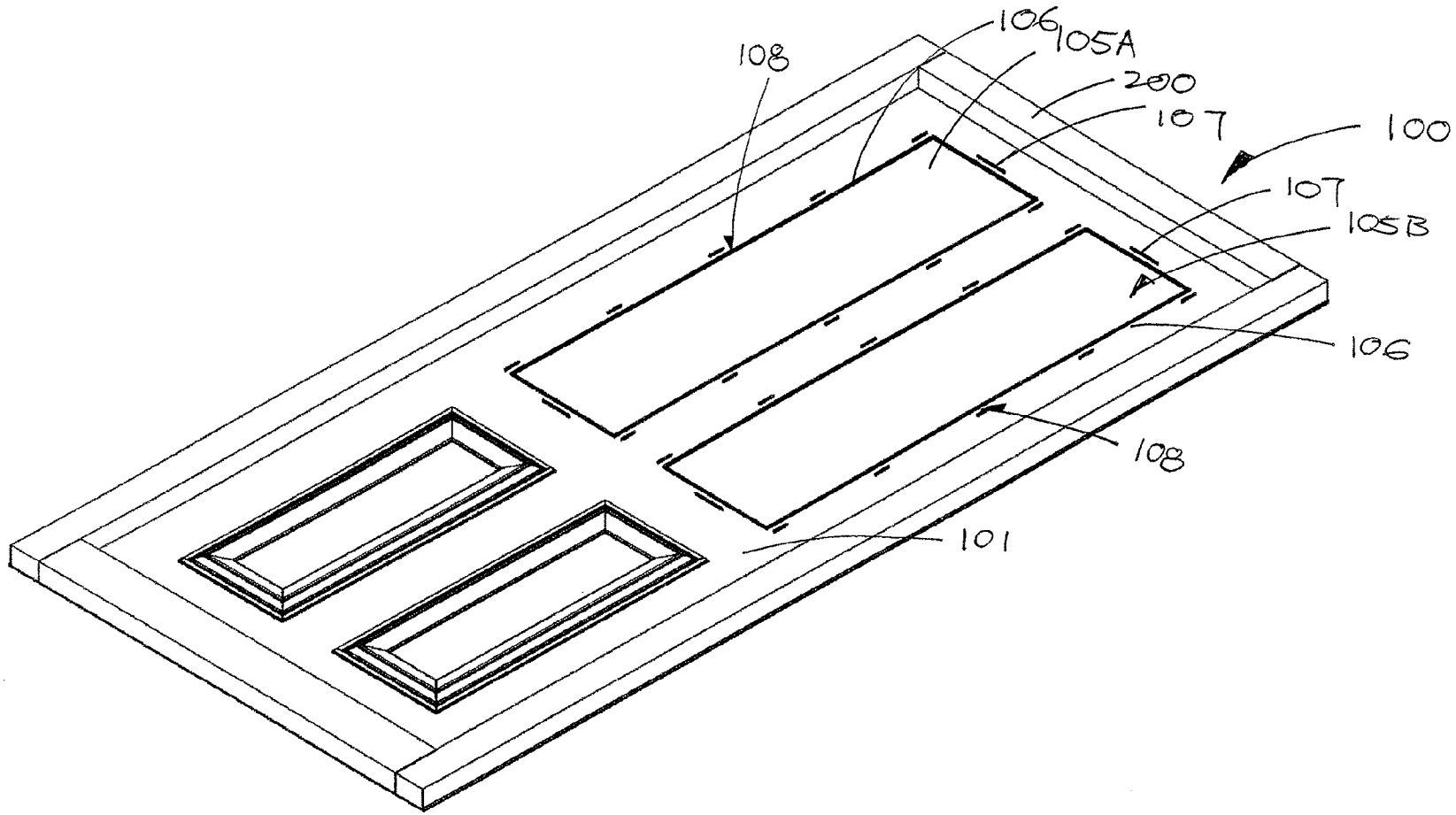
FIG. 4 is a perspective view of the front skin in FIG. 3 with a reinforcement frame placed thereon.
Figure 5:
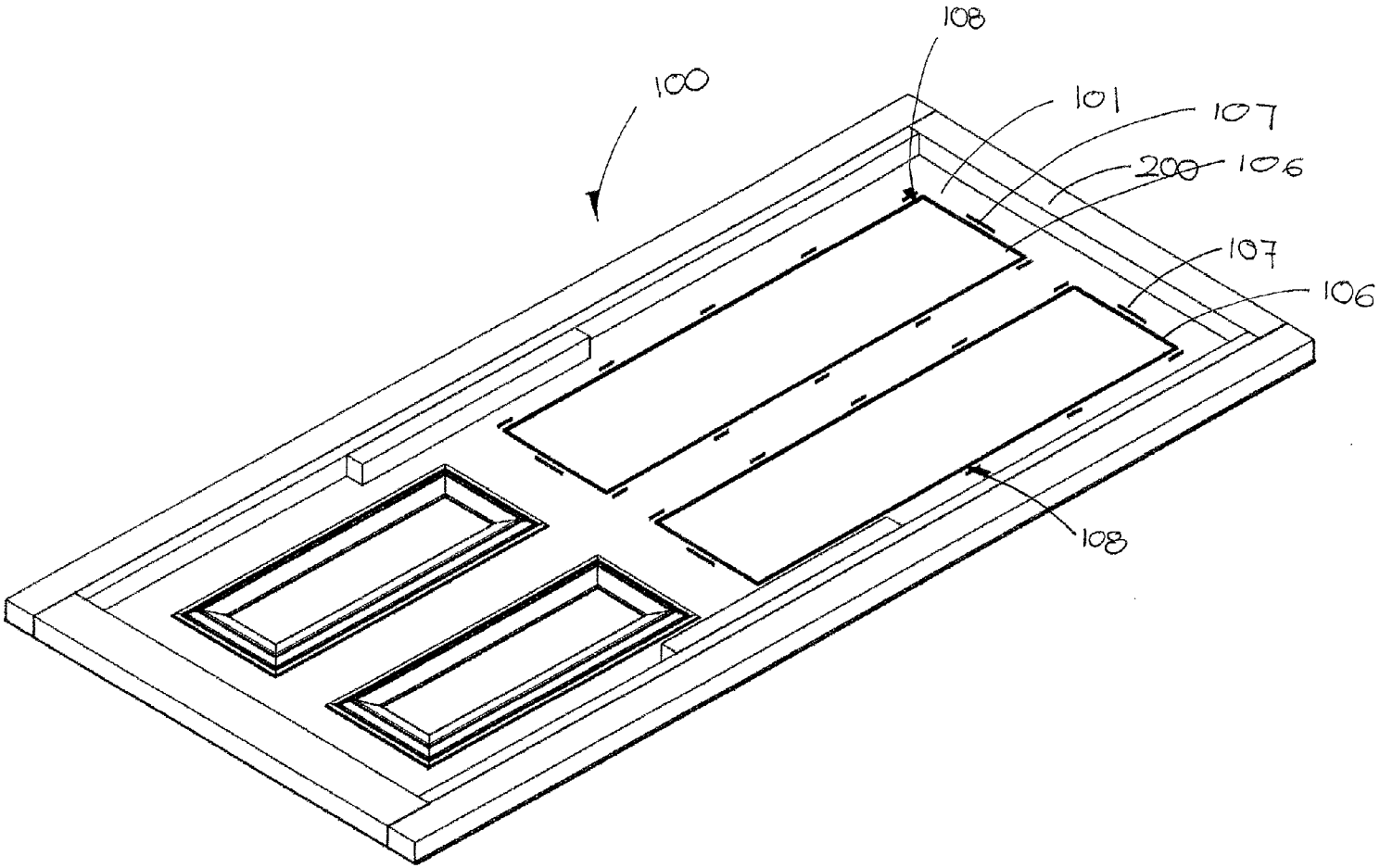
FIG. 5 is a perspective view of the front skin in FIG. 4 with the reinforcement frame and a lock block.

FIGS. 2A to 2C show the steps of assembling a glazing panel 104 to the door blank 100 in the first embodiment. The glazing panel 104 is placed in the aperture 105A/105B. The first and second holding members 110A and 110B each has a pair of opposite free edges. One of the free edges grips a side edge of the glazing panel 104 and the other free edge grips the front or rear skin 101 or 102. The holding members 110A and 110B hold the glazing panel 104 to the skins 101 and 102 by friction. The holding members 110A and 110B are snap-fitted to interlock with one another by the aforesaid retainers to fix their relative position. The retainer depicted has first and second retaining members 111A and 111B that interlock. Preferably, the retaining members 111A and 111B include a pair of complementary hook and recess formations. Alternatively, they may include two hook formations actively hooking onto one another as shown in FIG. 2C. The retaining members 111A and 111B may be releasably coupled to permit replacement of the glazing panel 104.

FIGS. 13A to 24 show the second embodiment of the door blank 100 in accordance with the invention. The front and rear skins 101 and 102 and the core 103 are structurally the same as those of the first embodiment. The frame for each glazing aperture 101A/101B includes an inner frame 109 and a holder 110. The first holding member 110A is integrally formed with the flange 109A or 109B of the inner frame 109 to form an integrated frame 109I. The second holding member 110B is a separate bead removably couplable or connectable with the first holding member 110A, and is preferably made up of four separate pieces which when assembled collectively form a frame.

Referring to FIGS. 15 to 24, the skins 101 and 102 and apertures 101A/101B or 102A/102B are formed by compression molding or molding compound. Alternatively, the skins 101 and 102 as well as the apertures 101A and 101B are formed by stamping/punching. A reinforcement frame 200 is laid on the inner side of the front skin 101 and runs along its outer perimeter. A lock block 201 is placed at the desired position widening the corresponding part of the reinforcement frame 200 to provide foundations for lock installation. The front flange 109A of the integrated frame 109I is located in the receiving zone 108 defined by the ribs 106 and 107 on the inner surface of the front skin 101. The rear skin 102 is then placed on the reinforcement frame 200, the lock block 201 and the integrated frame 109I, with the rear flange 109B of the integrated frame 109I being located in the receiving zone 108 defined by the ribs 106 and 107 on the rear skin 102. In other words, at least part of the integrated frame 109I, the reinforcement frame 200 and the lock block 201 are sandwiched between the front and rear skin 101 and 102. Adhesive may be used to bond the skins 101 and 102 to at least the reinforcement frame 200. The skins 101 and 102 are pressed towards each other, on opposite sides of the reinforcement frame 200 with lock block 201, while filling material is injected into a cavity defined by the integrated frame 109I, the skins 101 and 102, the reinforcement frame 200 and the lock block 201. The filling material bonds the front and rear panels 101 and 102 and the integrated frame 109I together, thereby resulting in a one-piece structure.

The integrated frame 109I and the apertures 101A, 101B, 102A and 102B of the front and rear skins 101 and 102 define the glazing apertures 105A and 105B. The construction of the inner frame 109 of the integrated frame 109I is generally the same as that in the first embodiment as described above. The integrated frame 109I prevents the filling material from entering the space with and between the apertures 101A, 101B, 102A and 102B and provides rigidity to the related glazing aperture 105A/105B.

The front and rear skins 101 and 102 define a space therebetween. The apertures 101A, 101B, 102A and 102B in the skins 101 and 102 are aligned to form the glazing aperture 105A and 105B. The frame, which includes the inner frame 109 and the holding members 110, is partly positioned between the skins 101 and 102 and extends along the glazing aperture 105A and 105B to delineate the space and define the cavity between the skins 101 and 102. The filling material is placed in the cavity to form the core 103 and bonds the skins 101 and 102 together forming a one-piece structure.

Same as that in the first embodiment, the filling material may be but not limited to polyurethane foam, phenolic foam or Styrofoam (i.e. closed-cell extruded polystyrene foam) to provide rigidity to the door blank 100. The skins may be made of, for example, fiberglass, PVC, fiber reinforcement plastic, steel, high-density fiberboard or medium-density fiberboard.

Figure 14C:
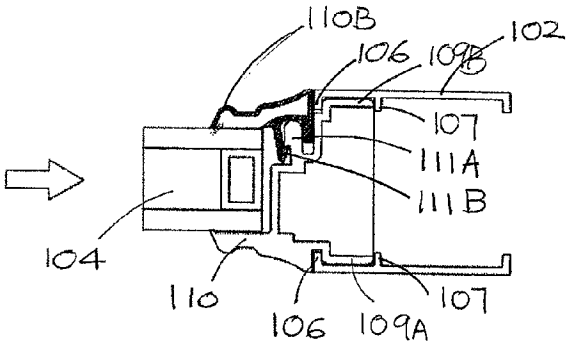
FIGS. 14A to 14C are schematic diagrams showing how a glazing panel for a window in the closure assembly in FIGS. 13A and 13B is assembled.
Figure 14B:
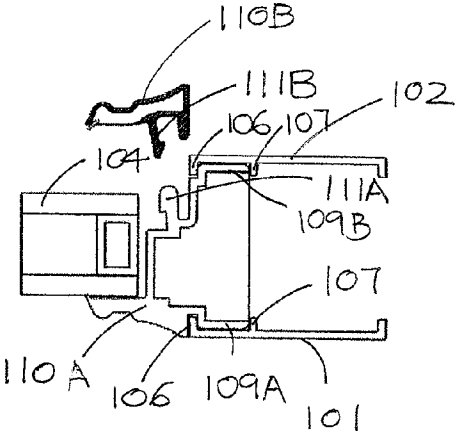
Figure 14A:
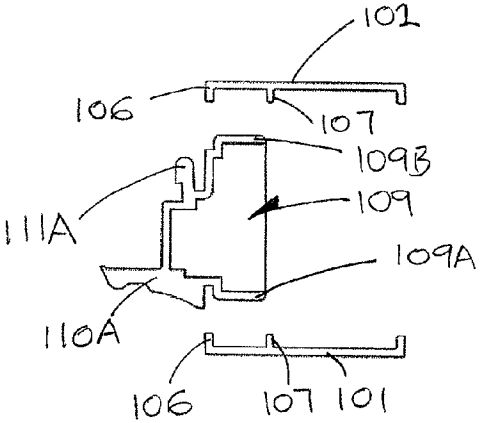
Figure 15:
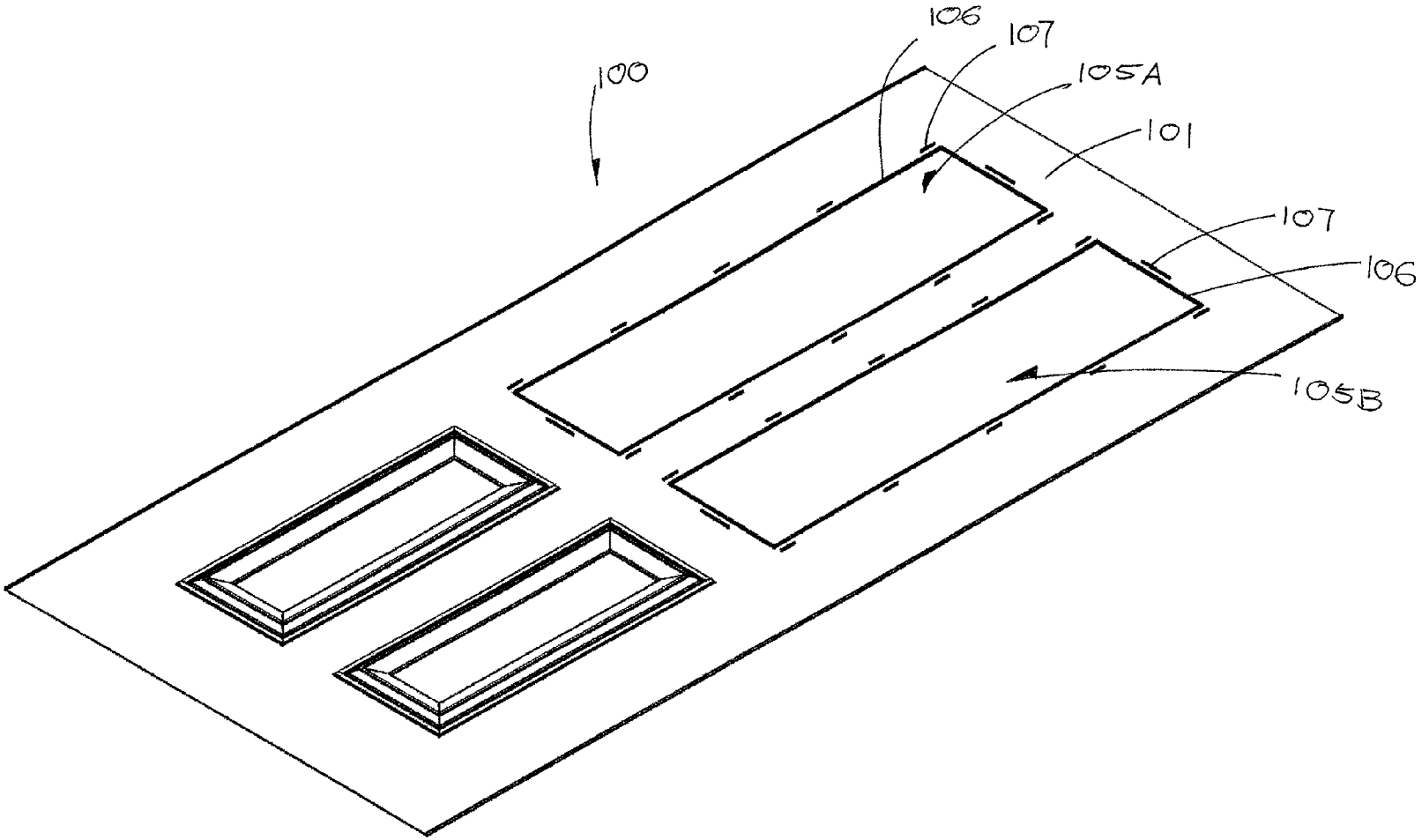
FIG. 15 is a perspective view of the first embodiment of a front skin of the closure assembly in FIGS. 13A and 13B.
Figure 16:
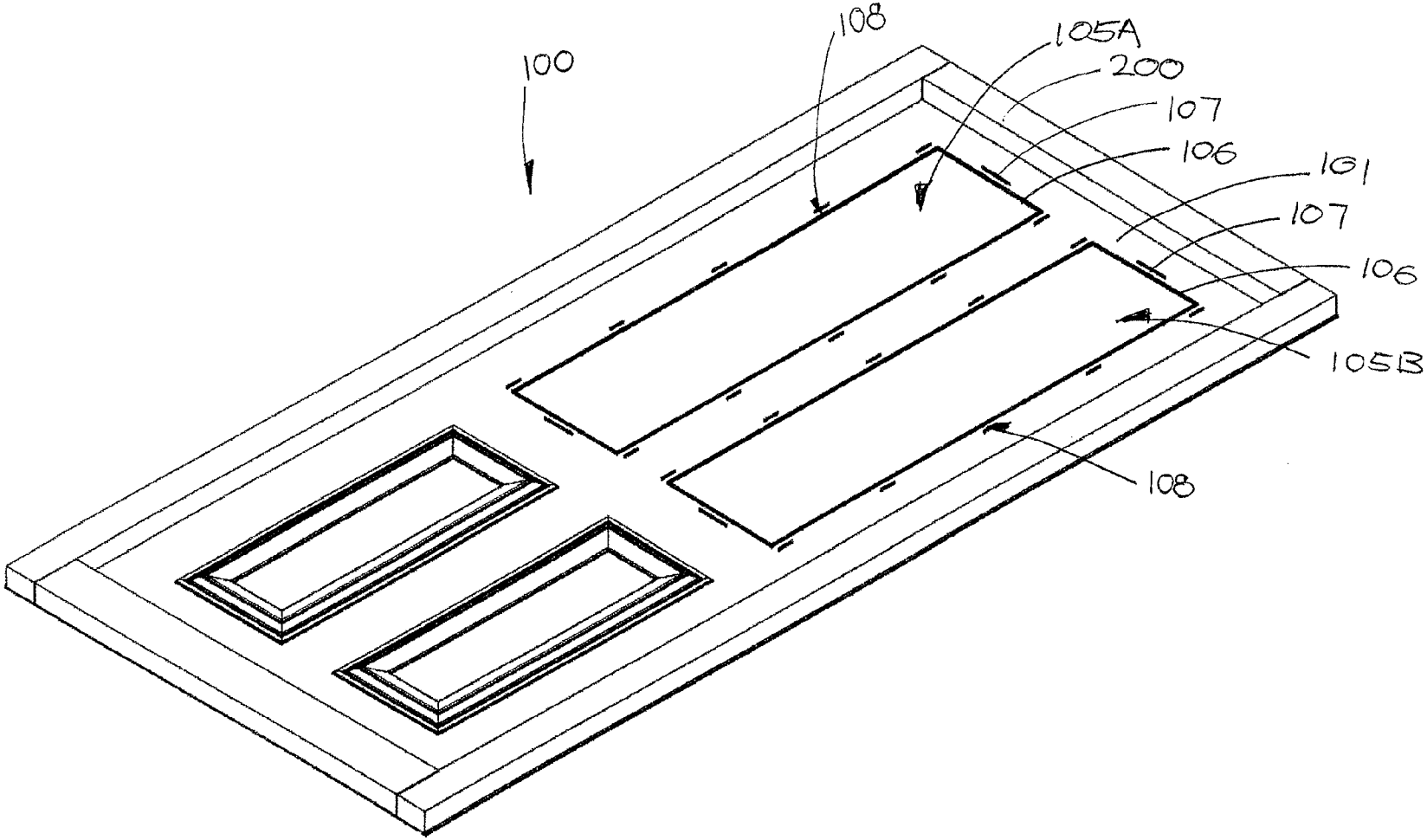
FIG. 16 is a perspective view of the front skin in FIG. 15 with a reinforcement frame placed thereon.
Figure 17:
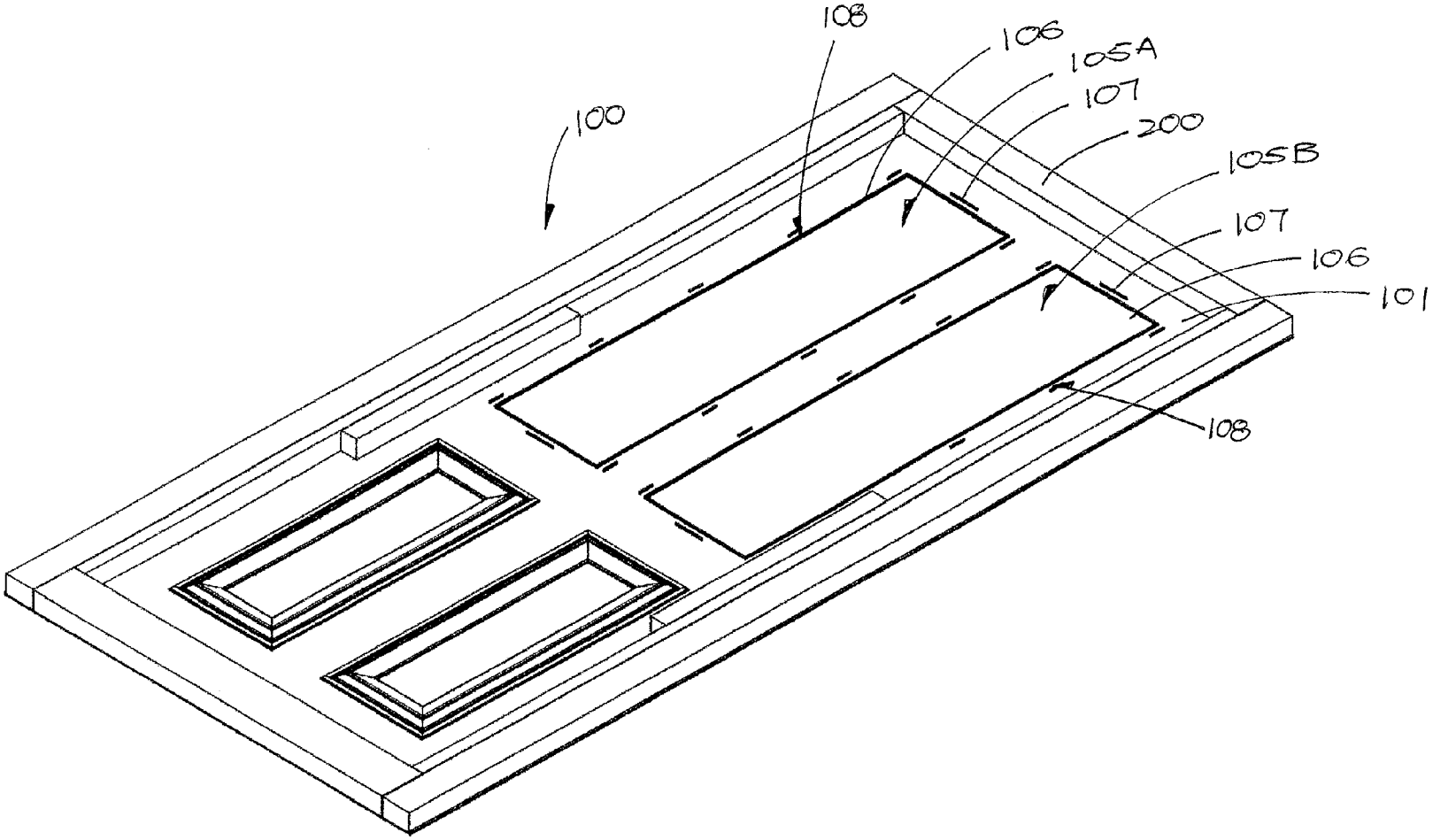
FIG. 17 is a perspective view of the front panel in FIG. 16 with the reinforcement frame and a lock block.
Figure 18:
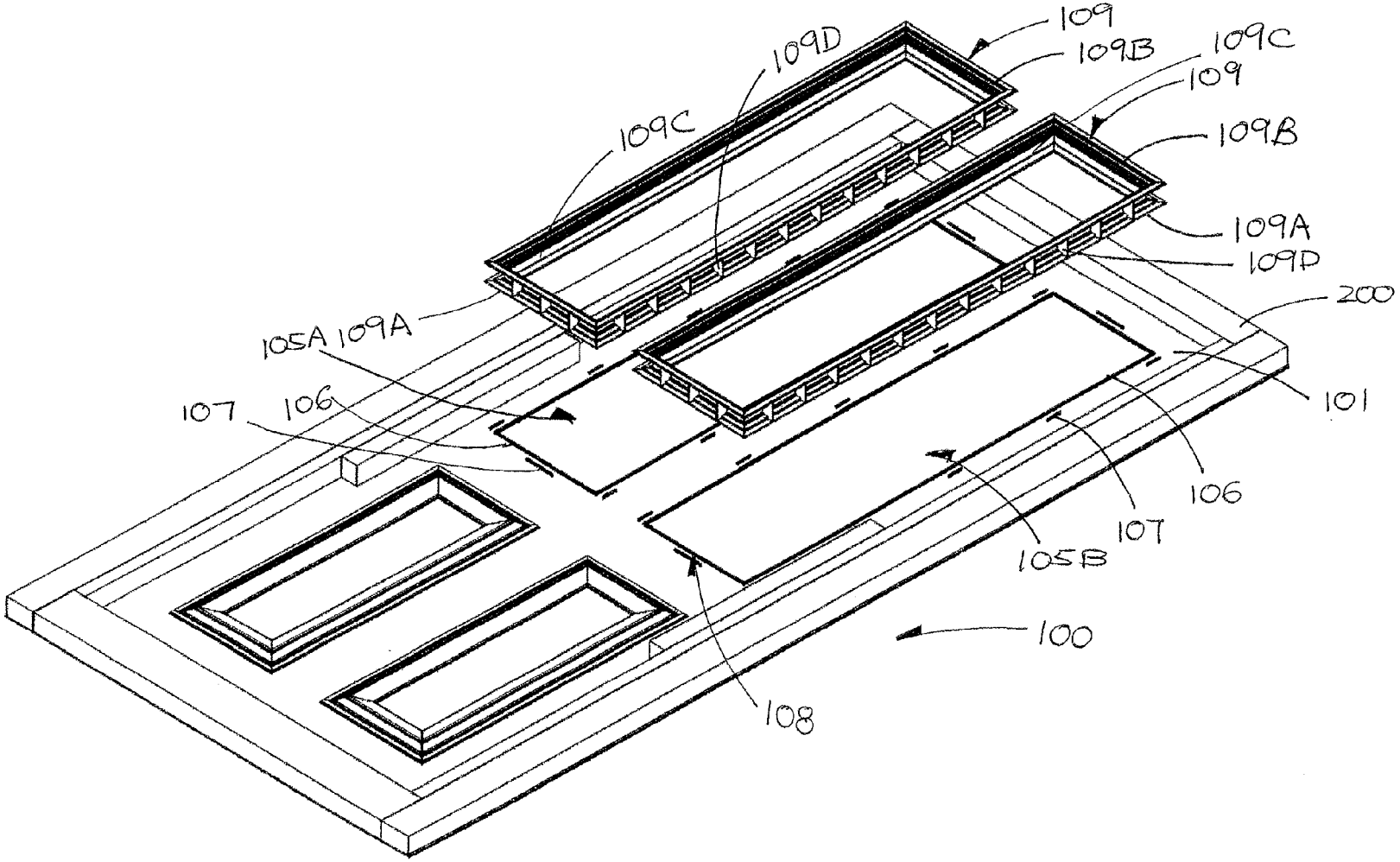
FIG. 18 is a perspective view of the closure assembly in FIG. 17 with an inner frame with an integrally formed first holding member to be assembled to apertures on the front skin.
Figure 19:
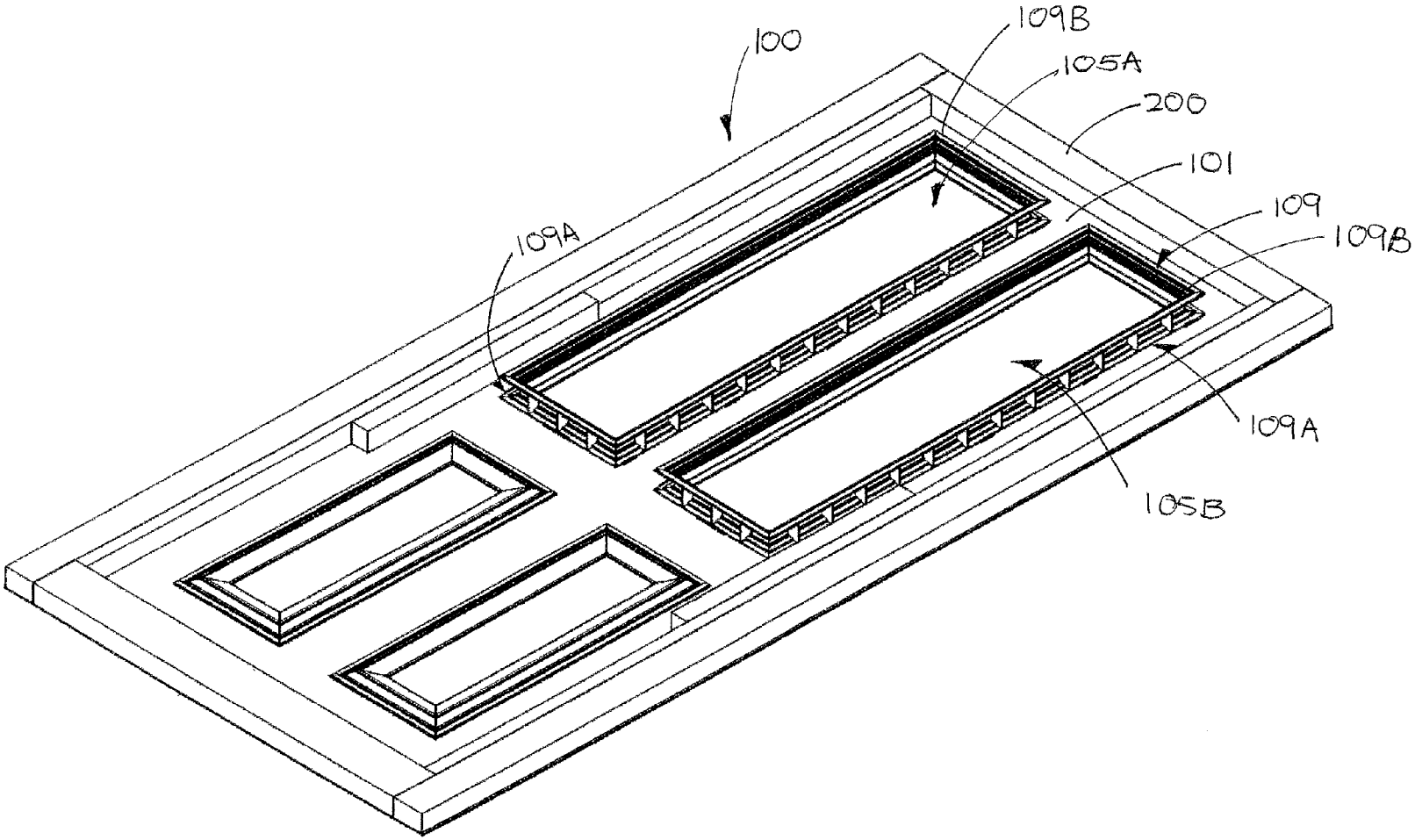
FIG. 19 is a perspective view of the closure assembly in FIG. 18 with the inner frame assembled on the apertures.
Figure 20:
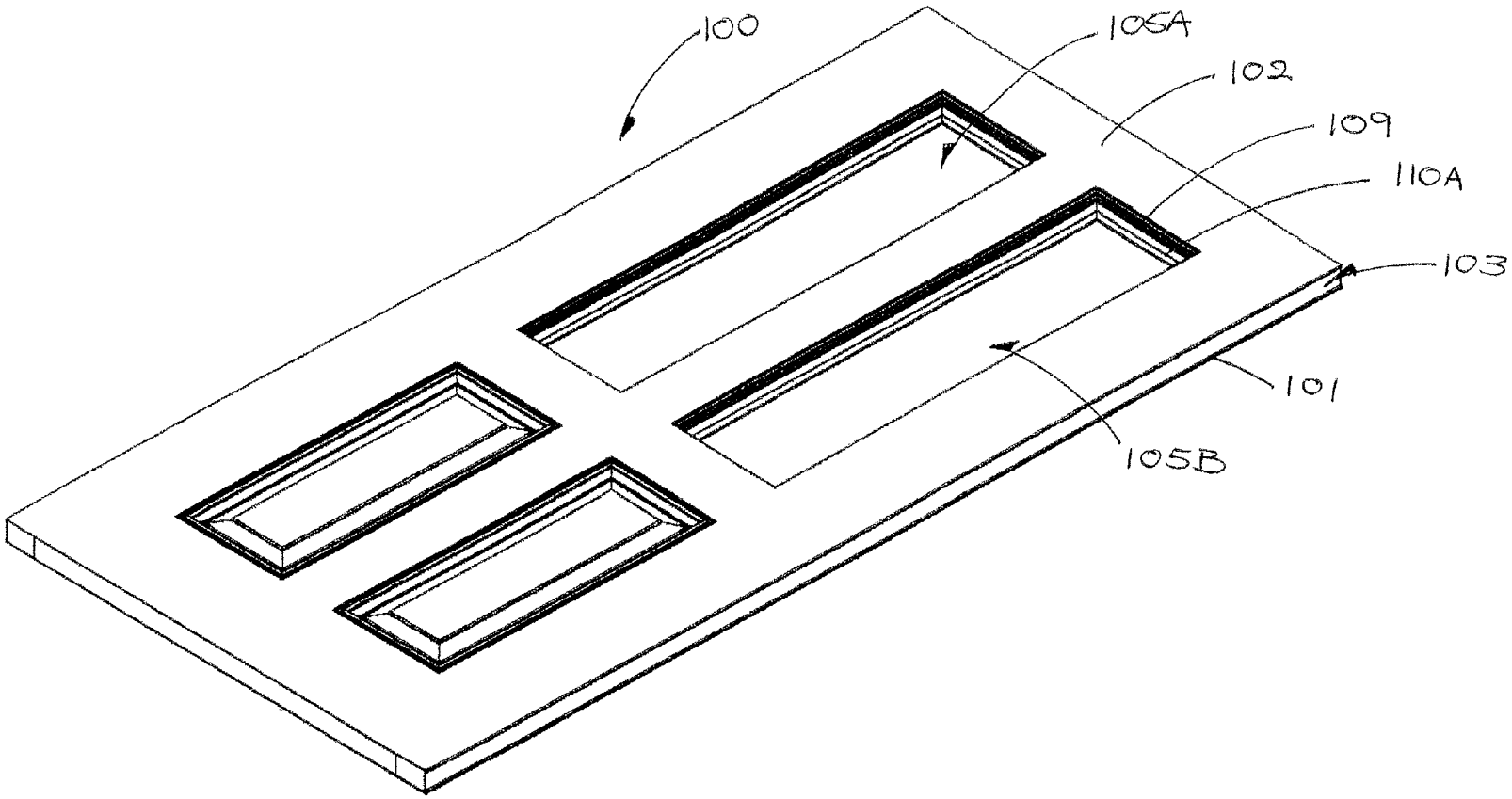
FIG. 20 is a perspective view of the closure assembly in FIG. 19 with the rear skin installed.
Figure 21:
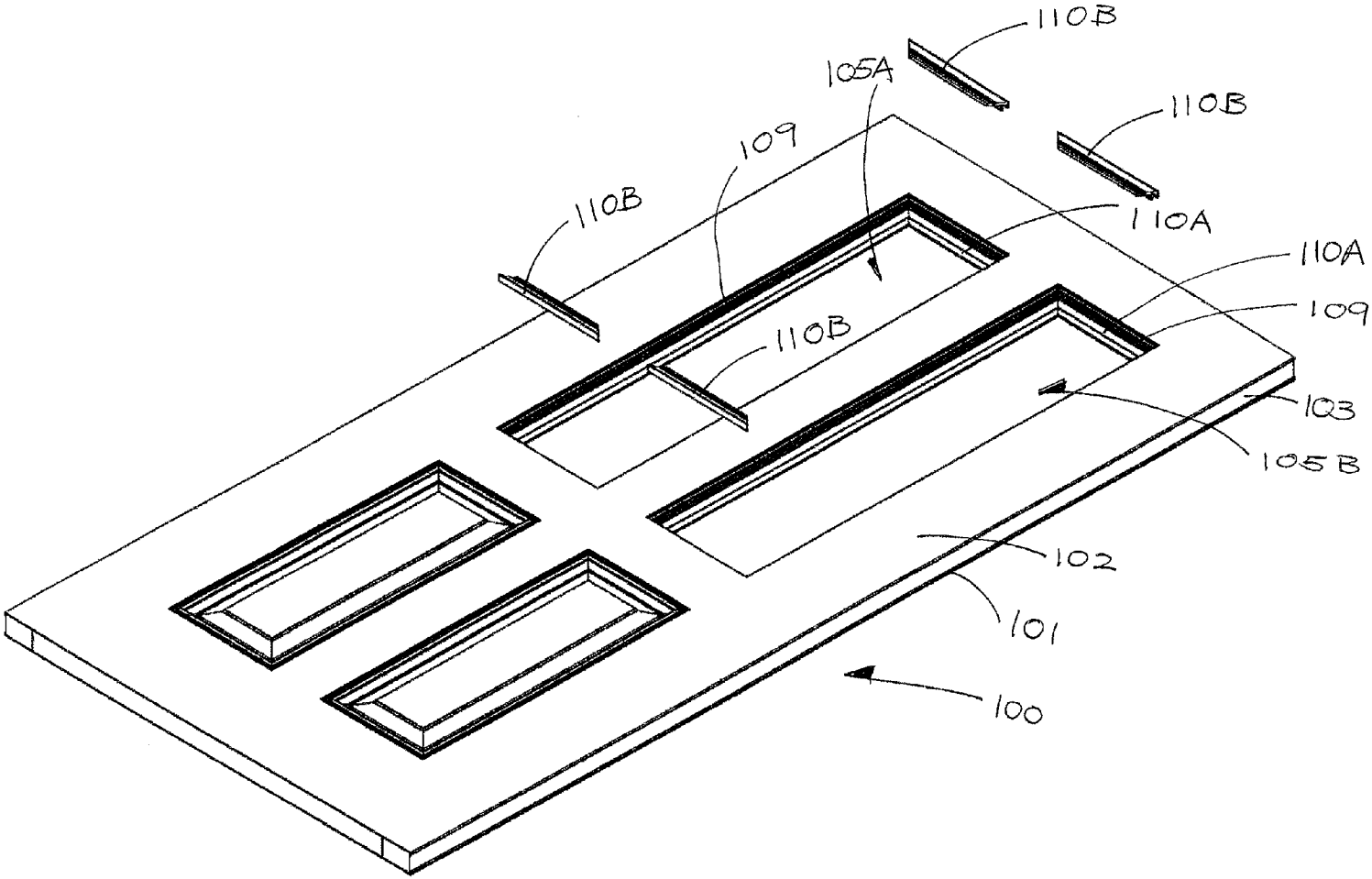
FIGS. 21 to 24 are perspective views of the closure assembly of FIG. 20 with a second holding member removably assembled.
Figure 22:
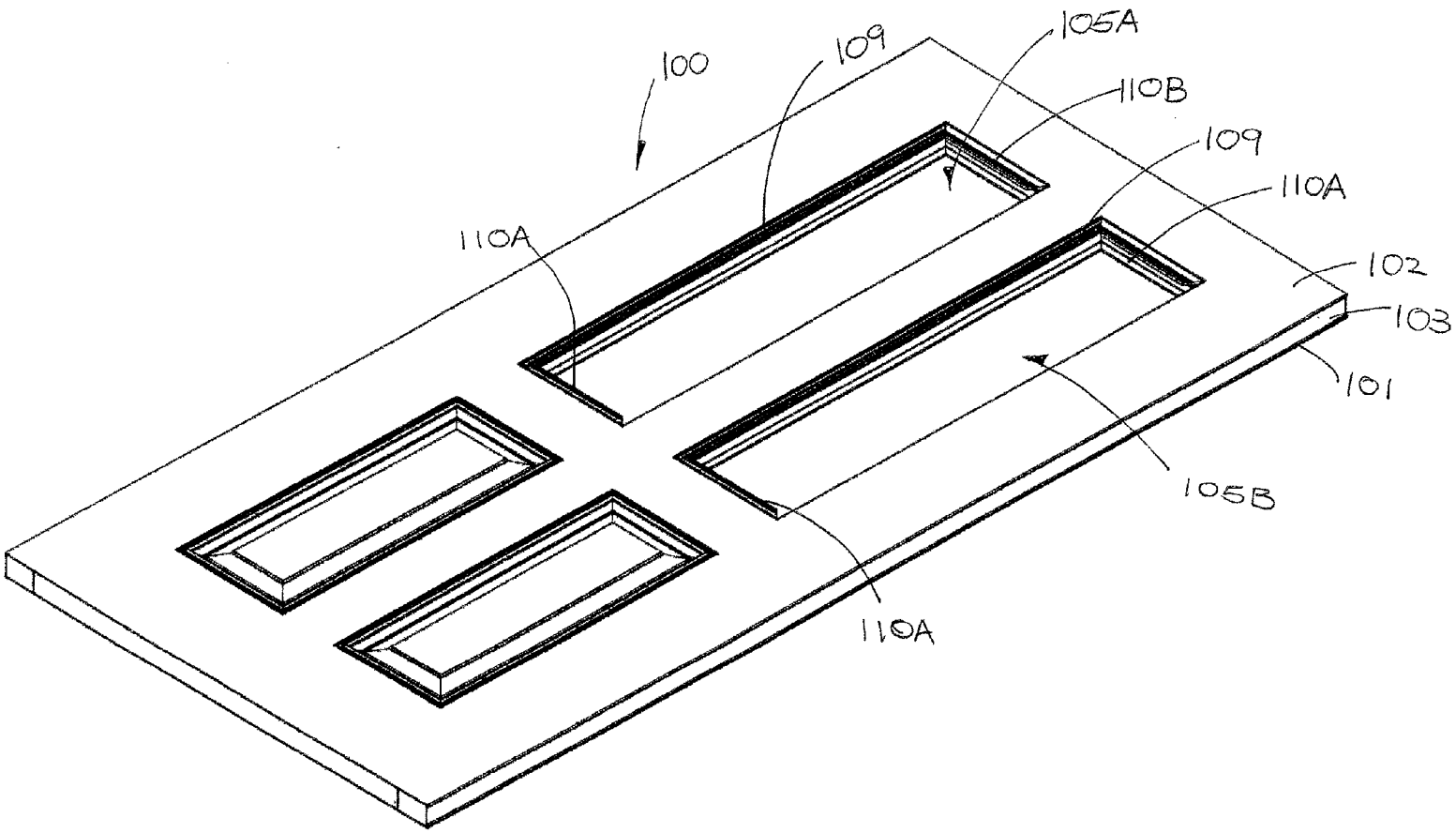
Figure 23:
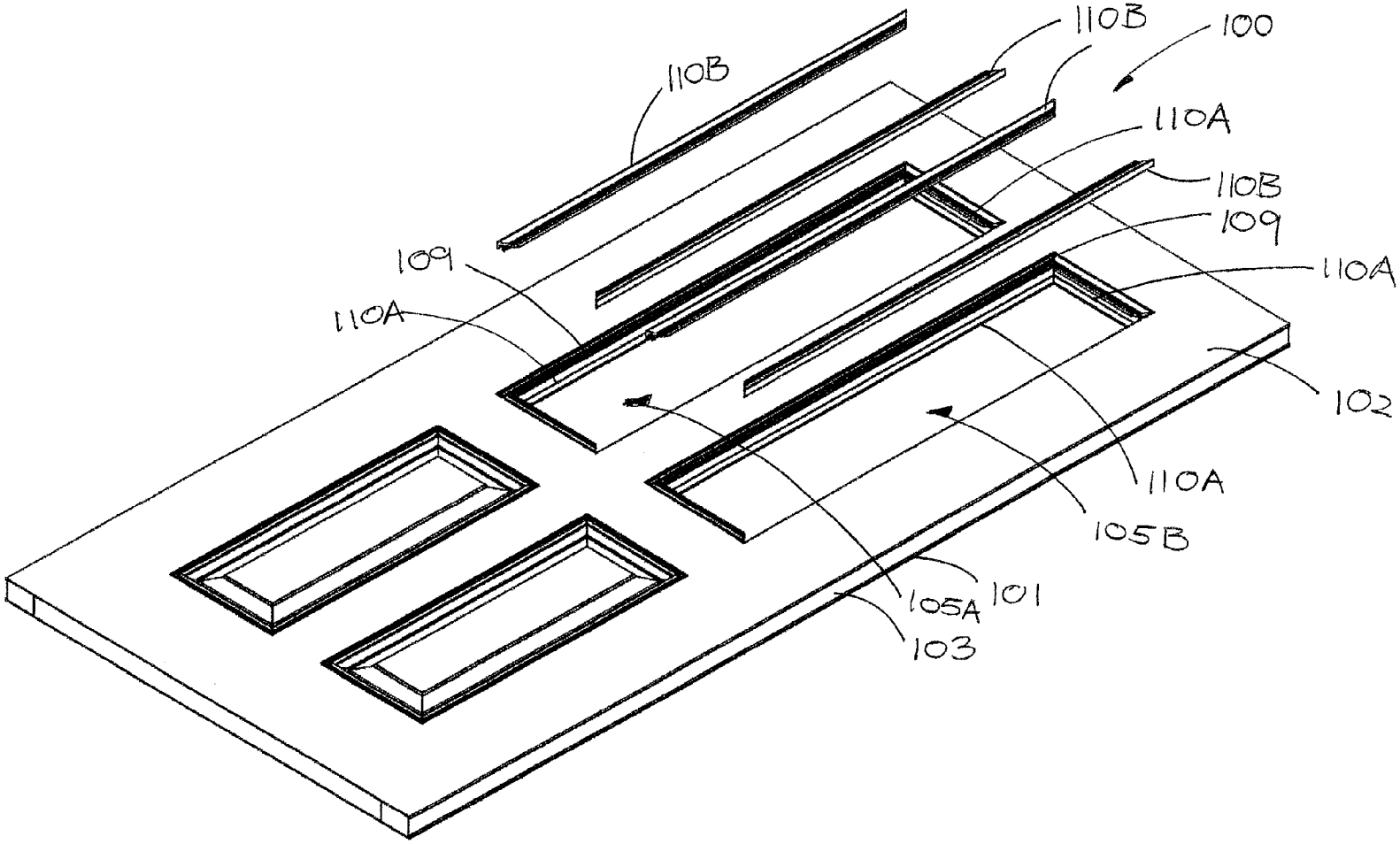
Figure 24:
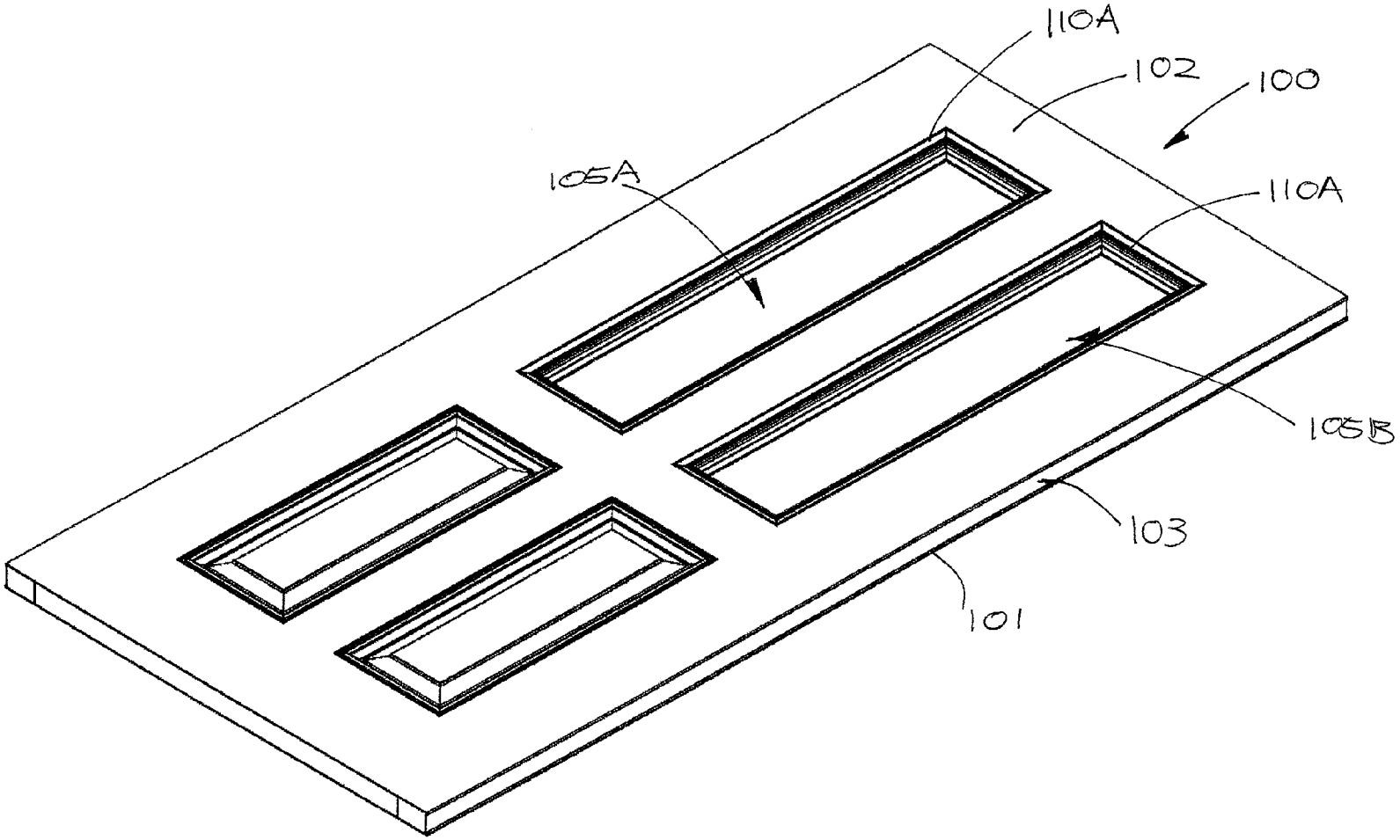

As shown in FIGS. 14A to 14C, one end of the first holding member 110A is integrally formed with the integrated frame 1091 and the other remains free for gripping onto the glazing panel 104. The glazing panel 104 is preferably of the double-glazing type, i.e. consisting of two panes of glass panels. To assemble the glazing panel 104 to the door blank 100, the glazing panel 104 is placed in the aperture 105A/105B, resting on the first holding member 110A, and then the second holding member 110B is placed upon the glazing panel 104 and running along the rim of the aperture 102A/102B of the rear skin 102. The second holding member 110B is snap-fitted laterally on to the integrated frame 1091. The glass panel 104 is held by friction between the two holding members 110A and 110B.

The first retaining member 111A is provided on the integrated frame 109I and preferably in the form of a recess or hook formation. The second retaining member 111B is provided with the second holding member 110B in the form of a complementary recess or hook formation. The two retaining members 111A and 111B interlock to couple the first and second holding members 110A and 110B by a snap-fit action. In an alternative embodiment, the retaining members 111A and 111B may be a pair of complementary hooks actively locking the first and second holding members 110A and 110B together.

More specifically, during forming of the window, one side of the glazing panel 104 is placed on the first holding member 110A, and the second holding member 110B is then placed on another side of the glass panel 104. The second retaining member 111B on the second holding member 110B is snap-fitted onto the first retaining member 111A on the integrated frame 109I. The two retaining members 111A and 111B interlock to fix the relative position between the holding members 110A and 110B as well as the position of the holding members 110A and 110B relative to the skins 101 and 102. The glazing panel 104 is clamped or held by friction between the two holding members 110A and 110B.

Referring to FIGS. 21 to 24, the second holding member 110B is composed of four separate or distinct pieces i.e. beadings which are pressed fit along one side after another around the rim of the glazing aperture 105A/105B to collectively form a rectangular frame around the glazing panel 104.

The beading process involving use of the second holding member 110B is a one-step process which secures the glazing panel 104 to the glazing aperture 105A/105B in a simple and quick manner.

The holding members 110A and 110B are embedded in the space between the skins 101 and 102 and in the glazing aperture 105A/105B. The holding members 110A and 110B do not project beyond the outer surface of the skins 101 and 102 leaving a smooth exterior on the door blank 100.

The second holding member 110B is removably retained or coupled to the aforesaid frame, and can be removed and recoupled to the frame. The provision of such a second holding member 110B is highly advantageous, because should it become necessary to replace the glass panel 104, it is convenient and straightforward to do so using the method of the present invention. Otherwise, it would be necessary to replace the whole door.

The formation of the apertures 105A and 105B requires no drilling or milling of the skins and the core materials. Wastage is minimized, making the door blank 100 more environmental friendly to make and use and lowering the overall cost of production considerably without involving a time-consuming preparation process such as cutting or milling.

Figure 25:
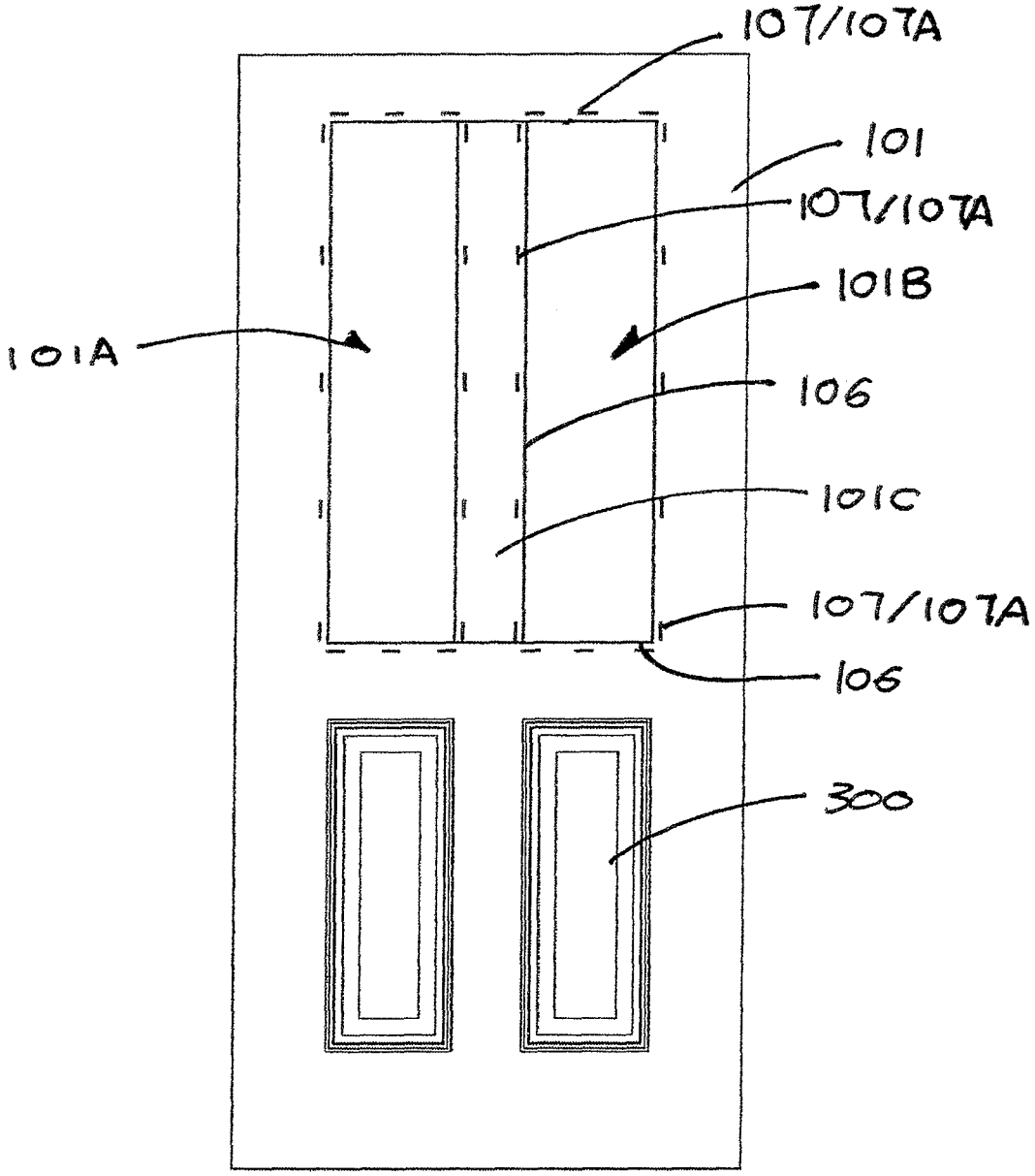
FIG. 25 is a front view of a second embodiment of a front skin in the closure assembly in any of FIGS. 1 to 24 with a divider delineated by ribs extending from the apertures on the front skin.
Figure 26:
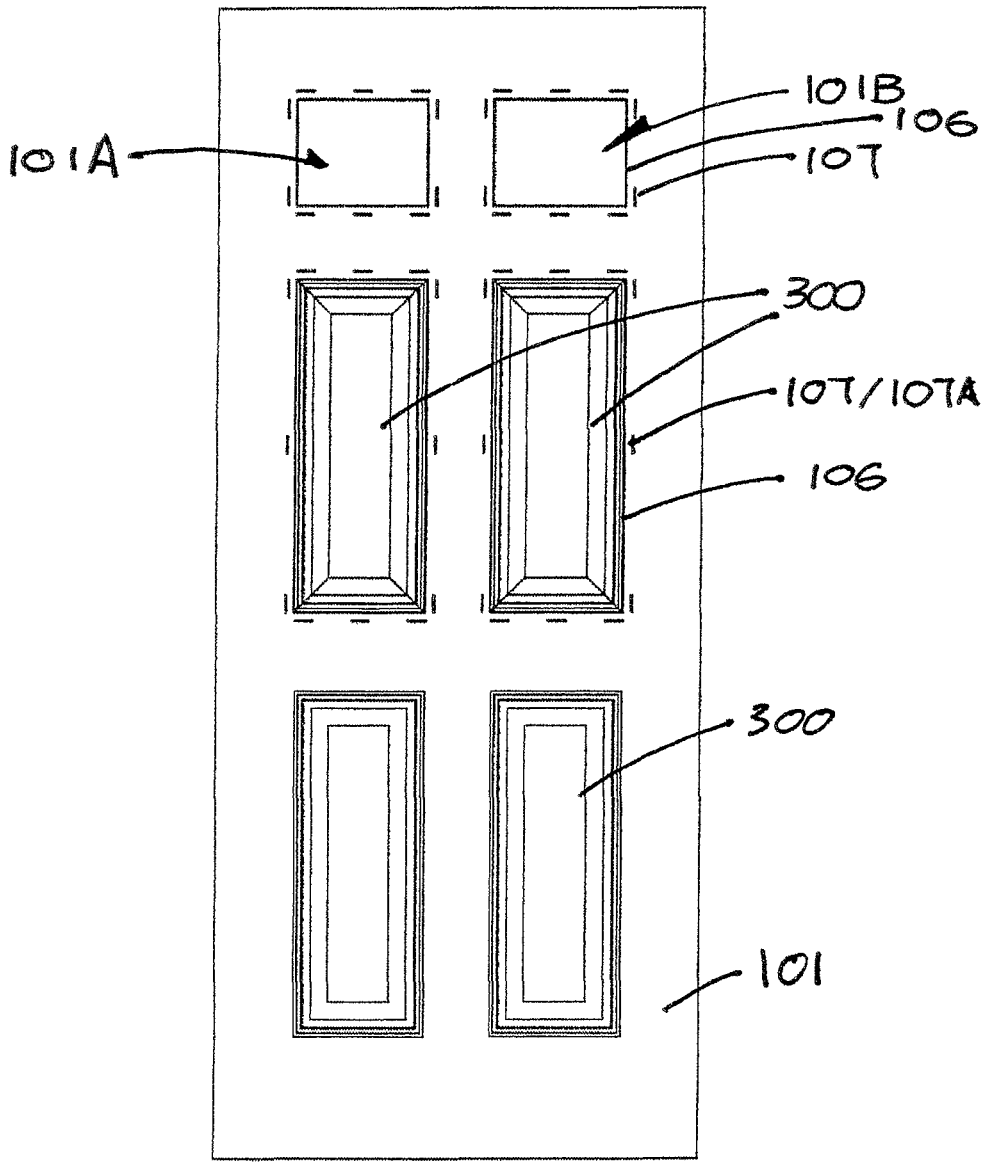
FIG. 26 is a front view of a third embodiment of a front skin in the closure assembly in any of FIGS. 1 to 24 with two panels surrounded by two rows of ribs.

In a further embodiment of the invention as shown in FIGS. 25 and 26, the apertures 101A and 101B can be integrated to form an enlarged aperture. Referring to FIG. 25, the apertures 101A and 101B are separated by a divider 101C which is more specifically known as a mullion. The mullion 101C may be removed by way of e.g. cutting to integrate the two apertures 101A and 101B and form an enlarged integrated aperture. The same applies to the rear skin 102 forming an enlarged integrated aperture. The two enlarged apertures are aligned to form an integrated glazing aperture. An inner frame or integrated frame matching the integrated glazing aperture may be used. This offers an option for customizing the door blank 100 according to needs by providing modifiable skins 101 and 102.

Each skin 101 or 102 has two ribs 106 and 107 defining a receiving zone 108 for receiving a flange 109A or 109B of the integrated frame 1091. The rib 106 of the apertures 101A and 101 B on the skins 101 and 102 extend across the mullion 101 C to delineate the same. Preferably, the rib 106 remains intact after the mullion 101 C is removed. That is to say, the rib 106 forms a continuous loop around the integrated glazing aperture and defines a receiving area 108 with the entire rib 107 or any remaining rib 107. The rib 107 is preferably a series of discontinuous rib sections. The inner frame or integrated frame is shaped and sized to match the integrated glazing apertures and it is assembled in the same way as that shown in FIGS. 2A to 2C and FIGS. 14A to 14C.

Referring to FIGS. 26 and 27, the decorative or sculptured paneling 300 such as boiserie in FIGS. 26 and 27 are provided on the front and rear skins 101 and 102. Corresponding panelings 300 on the front and rear skins 101 and 102 may be removed by way of cutting, drilling or milling to form a further aperture before filling materials are injected into the space between the skins 101 and 102. Ribs 106 and 107 are pre-formed onto an inner side of the skins 101 and 102 to define a receiving zone 108 for receiving the edges 109A and 109B of the inner frame 109 or integrated frame 109I as described above. The ribs 106 and 107 remain on the skin 101 or 102 after the paneling 300 is removed. The step of removing the panel is carried out prior to placement of the reinforcement frame 200 on the front skin 101.

The skins 101 and 102 in FIGS. 25 to 27 are compatible with and may be used with the inner frames or integrated frames in the first or second embodiment of the invention.

The invention has been given by way of example only, and various other modifications of and/or alterations to the described embodiments may be made by persons skilled in the art without departing from the scope of the invention as specified in the appended claims.

The invention claimed is:

1. A closure assembly with a window comprising:

front and rear panels defining a space between the front and rear panels, the front and rear panels each having a same construction;

an aperture in each of the front and rear panels, wherein the apertures are aligned to form an aperture in the closure assembly for the window;

a frame at least partly positioned between the front and rear panels and extending along the aperture in the closure assembly, delineating a portion of the space and defining a cavity between the front and rear panels, the frame including an inner frame sandwiched between the front and rear panels and a holder extending from the inner frame into the aperture in the closure assembly and running substantially parallel to the front and rear panels for holding a piece of glass for the window; and filling material located in the cavity and bonding the front and rear panels together in a one-piece structure;

wherein the holder includes a first holding member provided with the inner frame and extending from the inner frame into the aperture in the closure assembly, and a second holding member configured to cooperate with a releasable first retaining member of the first holding member for holding the piece of glass for the window, the second holding member being removable from and recouplable to the first holding member for replacing the piece of glass, and the second holding member is snap fitted onto at least two surfaces of the first holding member such that the second holding member is releasably retained on the first holding member by the releasable first retaining member for fixing a relative position between the first and second holding members, movement of the snap fitted second holding member on the first holding member being lateral relative to surfaces of the front and rear panels defining the space between the front and rear panels.

2. The closure assembly as claimed in claim 1, wherein the front and rear panels and the respective apertures in the front and rear panels are formed by compression molding.

3. The closure assembly as claimed in claim 1, wherein the front and rear panels and the respective apertures in the front and rear panels are formed by stamping or punching.

4. The closure assembly as claimed in claim 1, wherein the first holding member is integral with the inner frame.

5. The closure assembly as claimed in claim 4, wherein the front and rear panels constitute front and rear outer surfaces of the closure assembly, and the first and second holding members, when assembled, are embedded in the space between the front and rear panels and in the apertures of the front and rear panels, without protruding beyond the outer surfaces.

6. The closure assembly as claimed in claim 1, wherein the second holding member includes a second retaining member that interlocks with the releasable first retaining member and fixes relative positions of the first and second holding members.

7. The closure assembly as claimed in claim 6, wherein the second holding member being snap fitted onto the at least two surfaces of the first holding member secures the piece of glass for the window to the aperture of the closure assembly in a one step process of placing the second holding member in position.

8. The closure assembly as claimed in claim 6, wherein the first and second retaining members are releasably coupled to each other.

9. The closure assembly as claimed in claim 1, including engagement means fixing the frame in position between the front and rear panels.

10. The closure assembly as claimed in claim 9, wherein the engagement means includes:

a first engaging member extending into the space between the front and the rear panels; and a second engaging member receiving the first engaging member.

11. The closure assembly as claimed in claim 10, wherein the first engaging member comprises a receiving zone delimited by a pair of positioners which extend substantially transverse to the front and rear panels into the space, and the second engaging member comprises a projection dimensioned to be received in the receiving zone such that, when the first and second engaging members are engaged, relative planar movement between the front and rear panels and the frame, in a first direction, is constrained.

12. The closure assembly as claimed in claim 11, wherein each of the front and rear panels includes a first engaging member and the frame has two second engaging members for engaging the respective first engaging members.

13. The closure assembly as claimed in claim 11, wherein the pair of positioners comprises a first rib extending around the aperture in the closure assembly, and a second rib extending substantially parallel to and spaced from the first rib, defining the receiving zone.

14. The closure assembly as claimed in claim 13, wherein the second rib comprises a plurality of discontinuous rib sections.

15. The closure assembly as claimed in claim 13, wherein the first rib surrounds the aperture of the front panel or the rear panel and the second rib surrounds the first rib and is radially displaced from the first rib.

16. The closure assembly as claimed in claim 15, wherein the second rib comprises a plurality of discontinuous rib sections.

17. The closure assembly as claimed in claim 1, wherein the inner frame and the holder are separate parts.

18. The closure assembly as claimed in claim 17, wherein the holder comprises a glazing cassette.

19. The closure assembly as claimed in claim 17, wherein the first and second holding members grip the respective front and rear panels and cooperate with one another to hold the piece of glass for the window.

20. The closure assembly as claimed in claim 19, wherein the first and second holding members are identical in construction.

21. The closure assembly as claimed in claim 19, wherein the first and second holding members include locking means that interlock and fix relative positions of the first and second holding members.

22. The closure assembly as claimed in claim 21, wherein the first and second holding members form continuous loops around the aperture of the closure assembly and on the respective front and rear panels.

23. The closure assembly as claimed in claim 1, wherein each of the front and rear panels includes at least two apertures separated by a divider.

24. The closure assembly as claimed in claim 23, wherein the divider is removable to form an enlarged aperture integrating the two apertures in each of the front and rear panels.

25. The closure assembly as claimed in claim 24, wherein the frame is fixed in position between the front and rear panels by a first engaging member that extends into the space between the front and rear panels, and a second engaging member receiving the first engaging member, and the first engaging member comprises a first rib which extends substantially around the aperture of the closure assembly and delineates the divider such that, when the divider is removed, the enlarged aperture in the closure assembly is surrounded by the first rib.

* * * * *